US007703488B1

(12) United States Patent
Douglas

(10) Patent No.: US 7,703,488 B1
(45) Date of Patent: Apr. 27, 2010

(54) THROUGH DOVETAILING JIG ASSEMBLY

(76) Inventor: Lawrence M. Douglas, 8 Candleberry Ct., Bourne, MA (US) 02532-8334

( * ) Notice: Subject to any disclaimer, the term of this patent is extended or adjusted under 35 U.S.C. 154(b) by 521 days.

(21) Appl. No.: 11/731,347

(22) Filed: Mar. 30, 2007

Related U.S. Application Data

(60) Provisional application No. 60/791,784, filed on Apr. 14, 2006.

(51) Int. Cl.
*B27C 5/00* (2006.01)

(52) U.S. Cl. ..... 144/144.1; 144/85; 144/144.51

(58) Field of Classification Search ..... 144/85, 144/87, 114.1, 144.1, 144.51, 145.1, 135.2; 409/125, 130, 178, 182
See application file for complete search history.

(56) References Cited

U.S. PATENT DOCUMENTS 3,834,435 A * 9/1974 McCord, Jr. ..... 144/144.51
4,168,730 A 9/1979 Keller
4,405,004 A * 9/1983 Dicke ..... 144/87
4,407,344 A * 10/1983 Dicke ..... 144/87
4,428,408 A * 1/1984 Grisley ..... 144/144.51
4,542,776 A 9/1985 Kehoe
4,592,402 A 6/1986 Spofford
4,603,717 A 8/1986 Thomas
4,607,673 A * 8/1986 McCord, Jr. ..... 144/144.51
4,630,657 A 12/1986 Obradovich
4,655,445 A * 4/1987 Morse ..... 269/304
4,741,370 A 5/1988 Heaton
4,787,432 A 11/1988 Williams
4,809,755 A 3/1989 Pontikas
4,867,598 A 9/1989 Winter, IV
4,875,510 A 10/1989 Muellers
4,911,213 A * 3/1990 Le Bleu ..... 144/87
4,965,943 A 10/1990 Adams
4,995,435 A * 2/1991 Godfrey ..... 144/363
5,090,462 A 2/1992 Dimter
5,101,699 A 4/1992 Nezu
5,114,265 A 5/1992 Grisley
5,139,062 A 8/1992 Keller
5,143,132 A 9/1992 Keller
5,172,641 A 12/1992 Auer
5,203,389 A 4/1993 Goodwin
5,240,052 A 8/1993 Davison
5,241,732 A 9/1993 Tseng
5,285,832 A * 2/1994 Gibson ..... 144/144.51
5,318,082 A 6/1994 Von Hollen
5,351,590 A 10/1994 Everts et al.
5,382,753 A 1/1995 Farley
5,421,384 A * 6/1995 Nuwordu ..... 144/144.51
5,513,437 A 5/1996 Whyte
5,551,328 A 9/1996 Hsu
5,584,328 A 12/1996 Grisley
5,682,935 A 11/1997 Bustamante
5,692,861 A 12/1997 Stottmann
5,711,356 A 1/1998 Grisley
5,720,537 A 2/1998 Lutz (Continued)

*Primary Examiner*—Dana Ross
*Assistant Examiner*—Jennifer Chiang
(74) *Attorney, Agent, or Firm*—John P. McGonagle

(57) ABSTRACT

A through dovetailing jig assembly comprised of a dovetailing jig removably attached to a workpiece, an indexing strip removably attached to the workpiece and jig, and a front backup board removably attached to the workpiece and jig. The jig is further comprised of a removable pin insert and a removable tail insert.

22 Claims, 26 Drawing Sheets

U.S. PATENT DOCUMENTS 5,762,410 A 6/1998 Lutz
5,816,300 A 10/1998 Rogers
5,832,977 A * 11/1998 Hampton ..... 144/144.51
5,899,251 A 5/1999 Turner
5,931,208 A * 8/1999 Gifkins ..... 144/145.2
6,012,497 A 1/2000 Stottmann
6,032,706 A 3/2000 Lear
6,076,575 A * 6/2000 Harkness ..... 144/144.1
6,116,303 A * 9/2000 Hampton ..... 144/144.51
6,123,126 A 9/2000 Shanahan et al.
6,158,487 A 12/2000 Licari
6,305,449 B1 10/2001 Stover
6,315,017 B1 11/2001 Stottmann
6,422,276 B1 7/2002 Kevan
6,588,468 B1 7/2003 Tucker et al.
6,607,016 B2 8/2003 Jones
6,732,444 B2 5/2004 Allen
6,802,134 B2 10/2004 Allen
6,899,152 B2 * 5/2005 Godfrey ..... 144/144.51
7,455,089 B2 * 11/2008 McDaniel et al. ..... 144/144.1

* cited by examiner

THROUGH DOVETAILING JIG ASSEMBLY

CROSS-REFERENCE TO RELATED APPLICATIONS

Applicant claims the priority benefits of U.S. Provisional Patent Application No. 60/791,784, filed Apr. 14, 2006.

BACKGROUND OF THE INVENTION

This invention relates to woodworking, and, in particular, to a jig for making through dovetails.

A dovetail is a right-angled joint formed of one or more projecting parts, i.e., tenons or pins, that fit tightly within corresponding indentations, i.e., mortises or tails, to form a joint. The pin is typically broader at its end than at its base. Dovetail joints are considered by most carpenters and cabinet makers to be the strongest and most permanent joint made in carpentry and cabinet making. A dovetail joint is generally employed in articles made of thinner materials such as drawers, boxes, chests, and the like. FIG. 1 illustrates an example of dovetailing wherein the four pieces shown are interlaced, or dovetailed together at the corners, forming a rigid framework. The rigidity of the box is may be further increased by attaching a bottom (not shown) and a top lid (not shown), and/or by using adhesives.

The art of making through dovetails for wood joinery has been in practice for years. The art is most noticeable in the construction of old chests. Originally, to make a dovetail joint, a craftsman would layout the dimensions on a workpiece and produce the detail with saws and chisels. This is very time consuming requiring precision from one board to the mating board.

The modern day router has made this process much easier with the help of router cutters, holding fixtures and/or templates. With fixtures, the project sides are clamped into the fixtures and machined after setting up a template location. In most cases, the location of the "pin" boards and "tail" boards require different clamping locations and different template arrangements. All of these types of fixtures are costly. Smaller versions are less expensive but limit the width of project boards. Setting up appears to be the main complaint of clamping fixtures. The alignment of pin and tail boards, work stops from left to right, depth of cuts and the width of cuts are adjustments that are time consuming.

SUMMARY OF THE INVENTION

The present invention provides a jig attachable to a workpiece and adapted to guide router cutters in forming through dovetail pins and tails. The jig has a removable pin insert and a removable tail insert. The pin insert is adjustable. The present invention includes an indexing strip for alignment of pins and tails. The present invention is small in size relative to clamping fixtures and is constructed with fewer and simpler parts. The present invention is independent of a clamping fixture. Setting up is very simple with the present invention. The present invention jig is simply clamped in place and, with minor adjustments, is ready to be used. The work piece itself is clamped in a vice with no alignment considerations other than the correct end facing up. Alignment takes place after securing the present invention jig and indexing strip to the workpiece.

The present invention jig is particularly advantageous when used with warped boards. Prior art clamping fixtures, as well as template arrays, all require the project board to be very flat for proper alignment. This is one of the reasons that prior art fixture clamps must be robust. If the project board is warped, even when clamped, cuts are made as though the board end was flat. The present invention clamps into place along a small part of the bowed edge of a warped board, thus aligning the cut relative to the bow rather than perpendicular to the clamping fixture, thus minimizing the effect of the warped board.

After cutting the pins in one end of a project board using a prior art bench fixture and template arrangement, the board must be rotated 180 degrees and reclamped to cut the board's opposite end. If the board is aligned to the same stop, the dimension from the board edge to the first pin must be exactly the same as the already cut pin opposite it. This is unlikely because it was the last pin cut on the first end. If it is aligned to the opposite side, now in theory, the first pin to be cut is in line with the first pin cut on the opposite end, the arrangement of guides must be exactly the same going in the opposite direction. Inaccurate alignment of assembly edges result. The present invention jig compensates for this by using indexing strips. When the project board is rotated 180 degrees for cutting the opposite end, the invention indexing strip is simply rotated 180 degrees as well aligning the arrangement of cuts to remain aligned with a common edge of the board.

The present invention also reduces splintering. Splintering occurs when machining through wood. It happens when a cutter pushes a splinter outward rather than cutting through it. Splintering can happen in both directions since a machine may still be running as it is withdrawn. Both sides of pin cuts and tail cuts have to be backed up with boards if the cuts are to be splinter free. This would require three thicknesses of boards to be clamped together in a prior art clamping fixture. This requires a larger and even more robust clamp. Realigning backup boards to new cuts can be troublesome. With a prior art bench array fixture, that cut has to be repeated for each cut. With the present invention jig, a front backup board remains with the jig eliminating realignment and recutting. The present invention indexing board also serves as a rear backup board automatically keeping previously cut backup cuts useful for the following cuts.

The size of prior art clamping fixtures limit project board widths. Prior art array pattern templates require "butting" for wider boards. Maintaining mating dimensions with butting is, at best, difficult. There is no width limit using the present invention jig.

The present invention meets the above objectives by providing a through dovetailing jig assembly comprised of a dovetailing jig removably attached to a workpiece, an indexing strip removably attached to the workpiece and jig, and a front backup board removably attached to the workpiece and jig. The jig is further comprised of a removable pin insert and a removable tail insert.

These, together with other objects of the invention, along with various features of novelty which characterize the invention, are pointed out with particularity in the claims annexed hereto and forming a part of this disclosure. For a better understanding of the invention, its operating advantages and the specific objects attained by its uses, reference should be had to the accompanying drawings and descriptive matter in which there is illustrated a preferred embodiment of the invention.

DETAILED DESCRIPTION OF THE INVENTION

Figure 1:
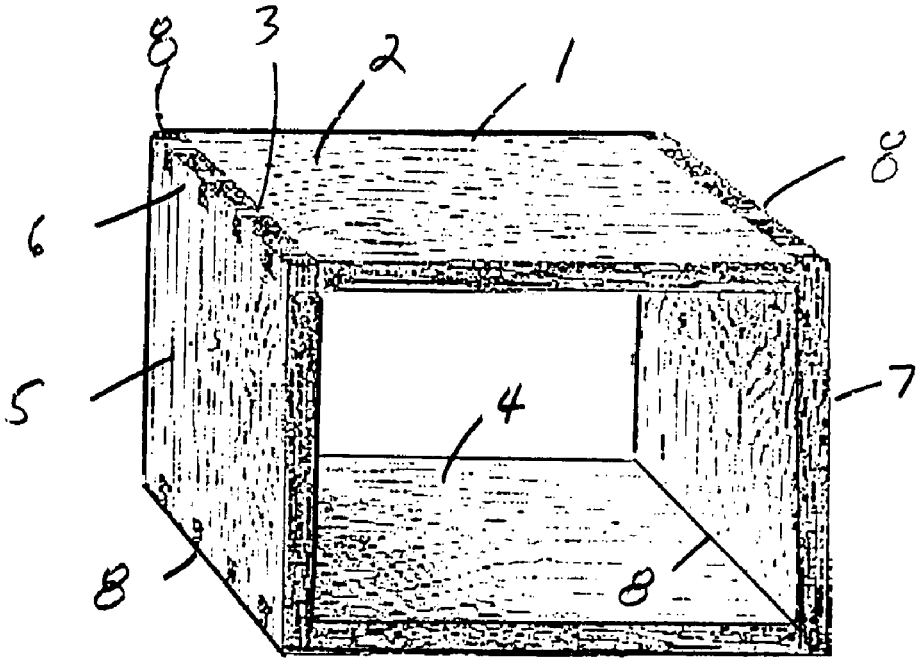
FIG. 1 is a perspective view of a box with four dovetail joints.
Figure 2A:
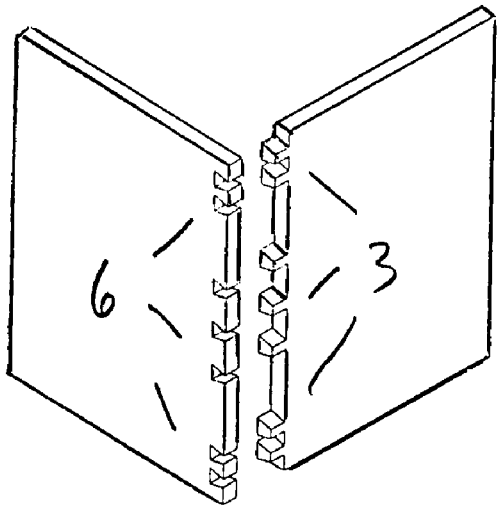
FIG. 2A illustrates two boards, one board terminating in a plurality of pins and the other board terminating in a plurality of tails.
Figure 2B:
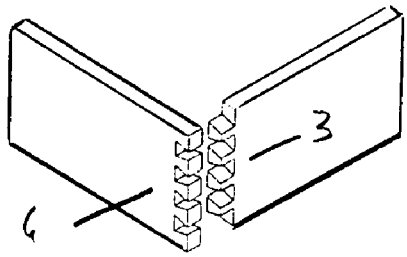
FIG. 2B illustrates two boards as in FIG. 2A but with a different spacing array of pins and tails.
Figure 3:
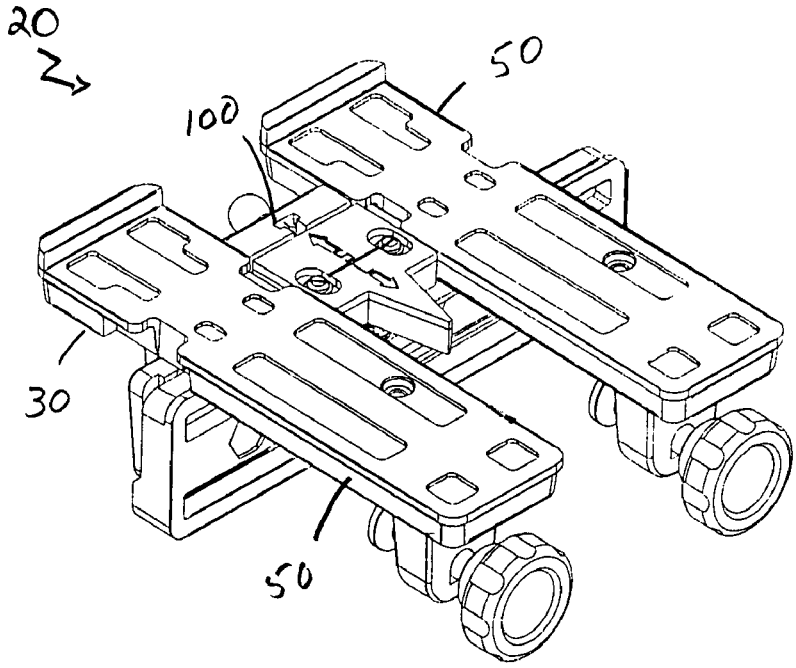
FIG. 3 is a top perspective view of a jig with pin cutting insert.
Figure 4:
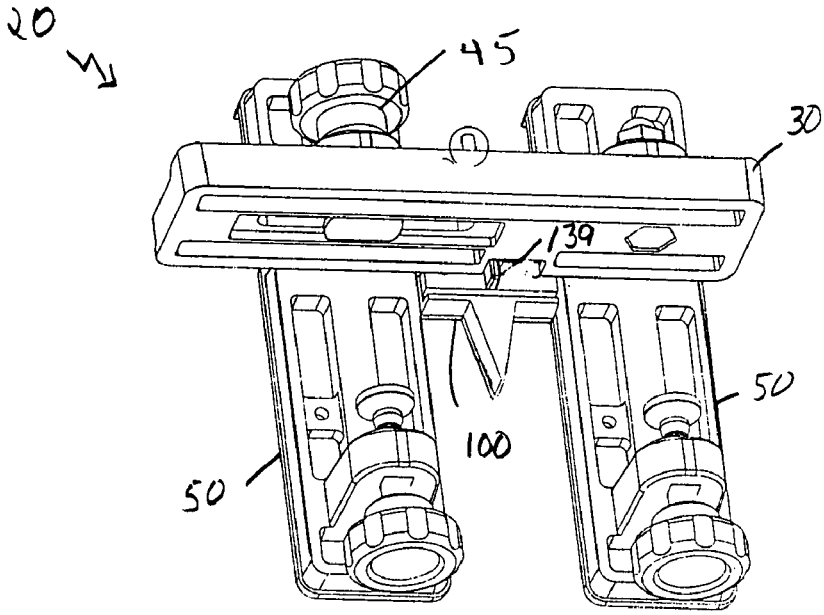
FIG. 4 is a bottom perspective view thereof.
Figure 5:
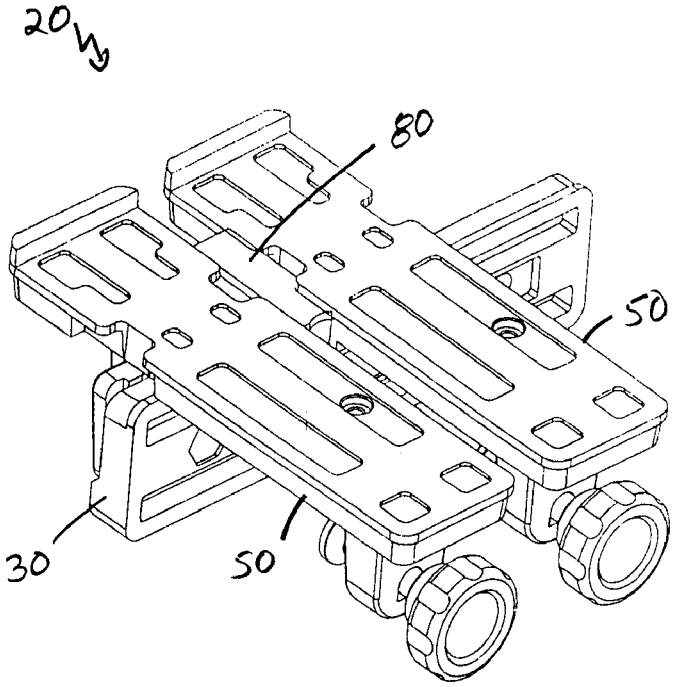
FIG. 5 is a top perspective view of a jig with tail cutting insert.
Figure 6:
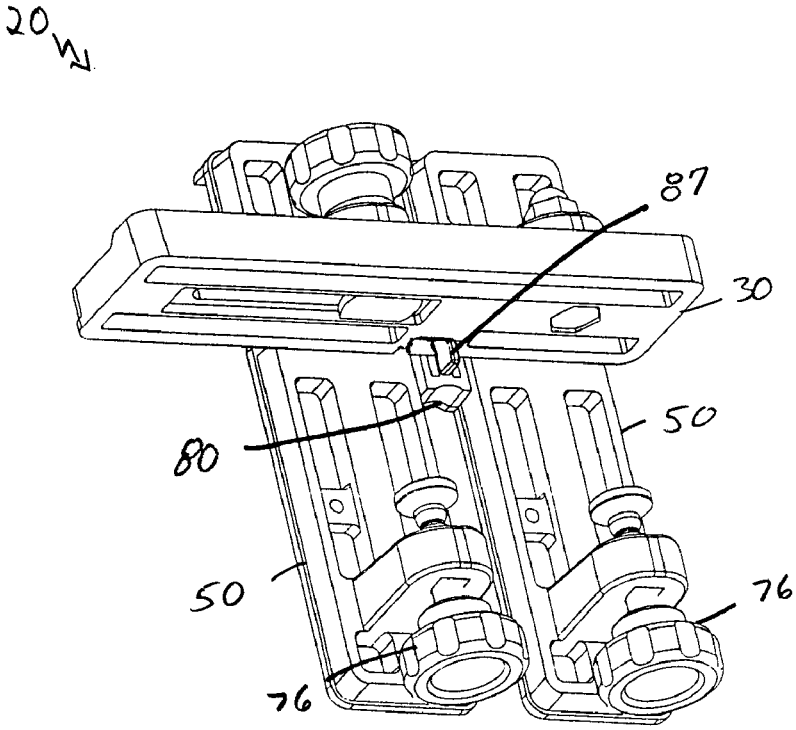
FIG. 6 is a bottom perspective view thereof.
Figure 7:
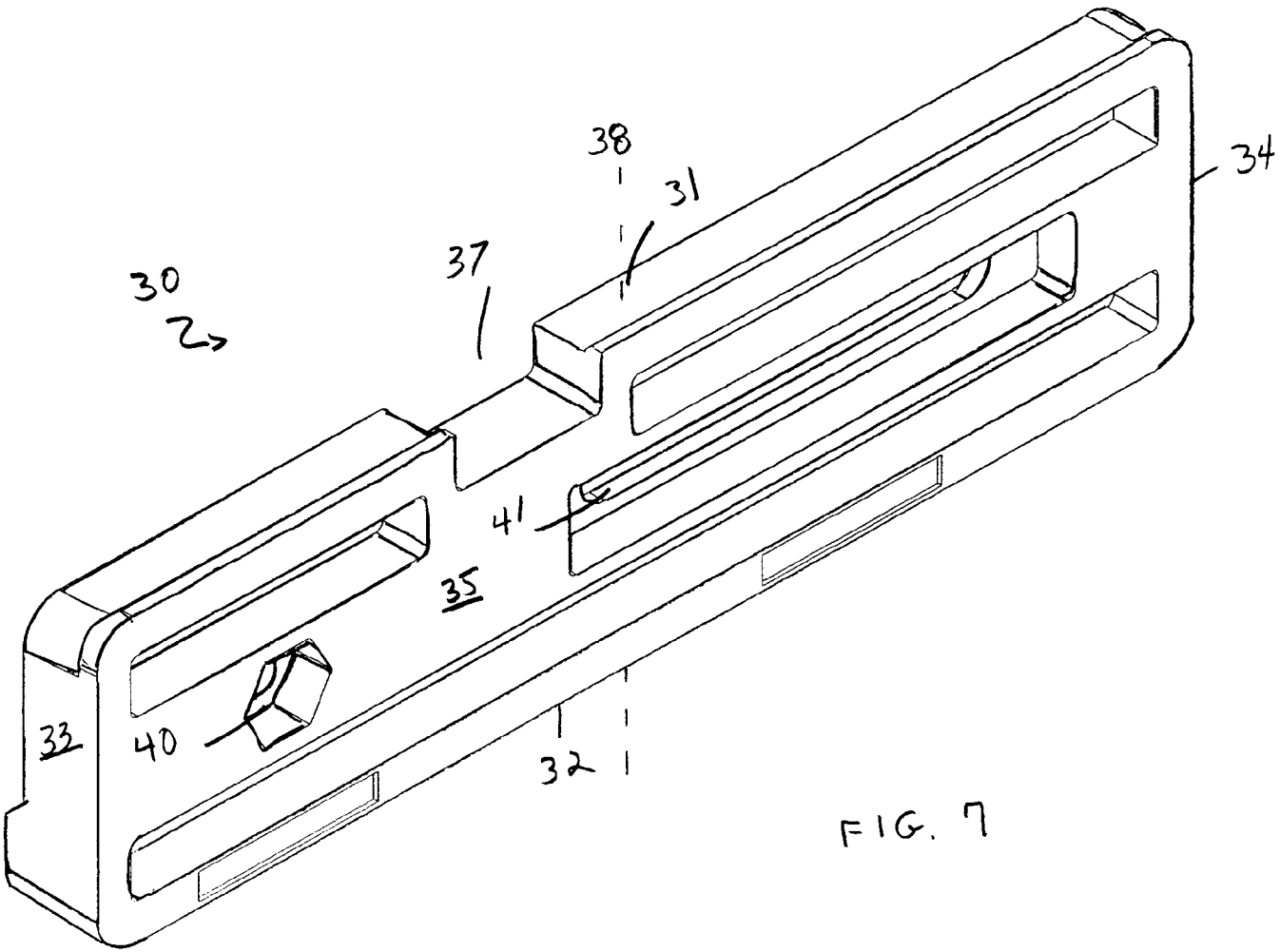
FIG. 7 is a front perspective view of the jig support base.
Figure 8:
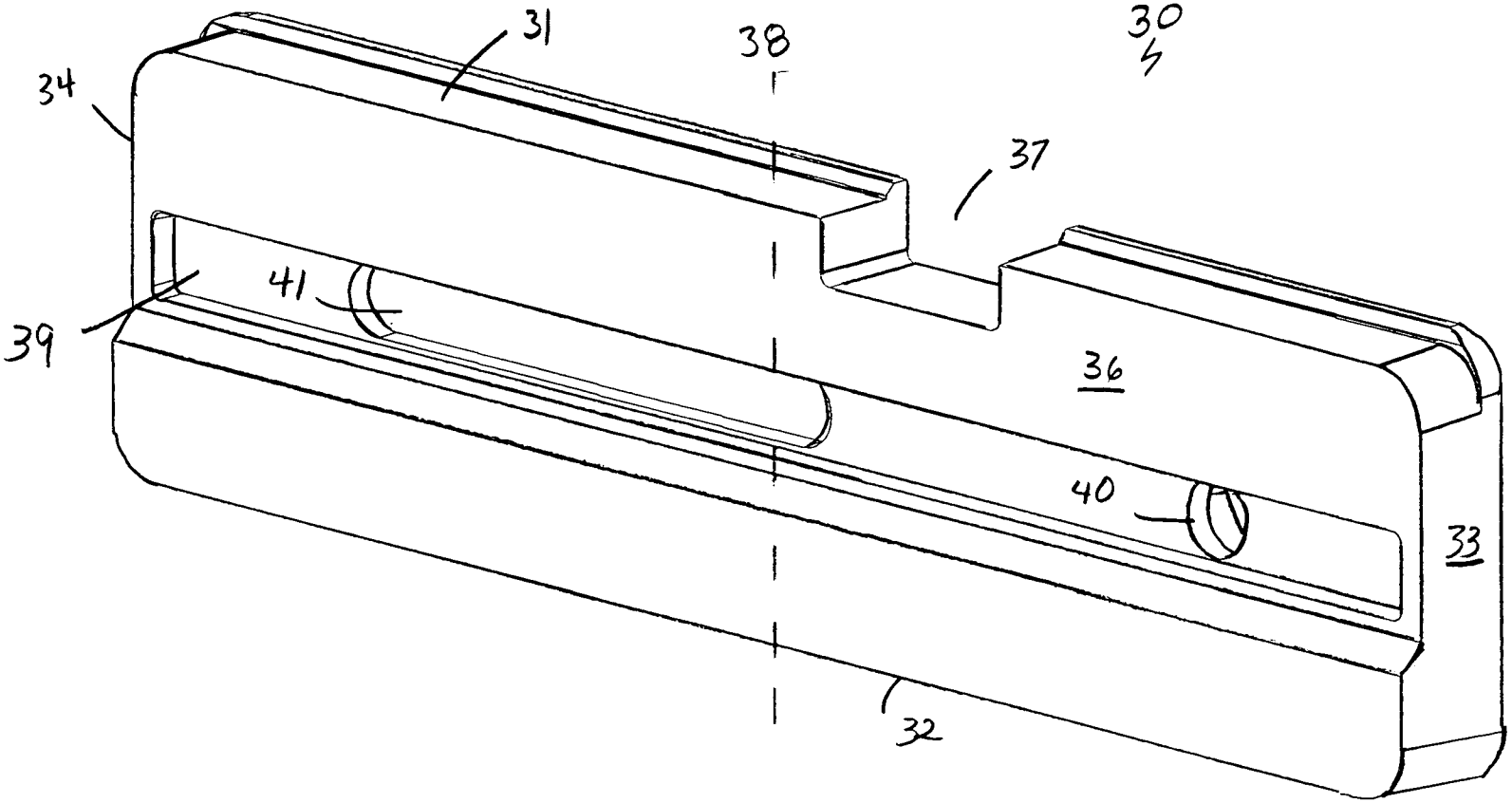
FIG. 8 is a rear perspective view of the jig support base.
Figure 9:
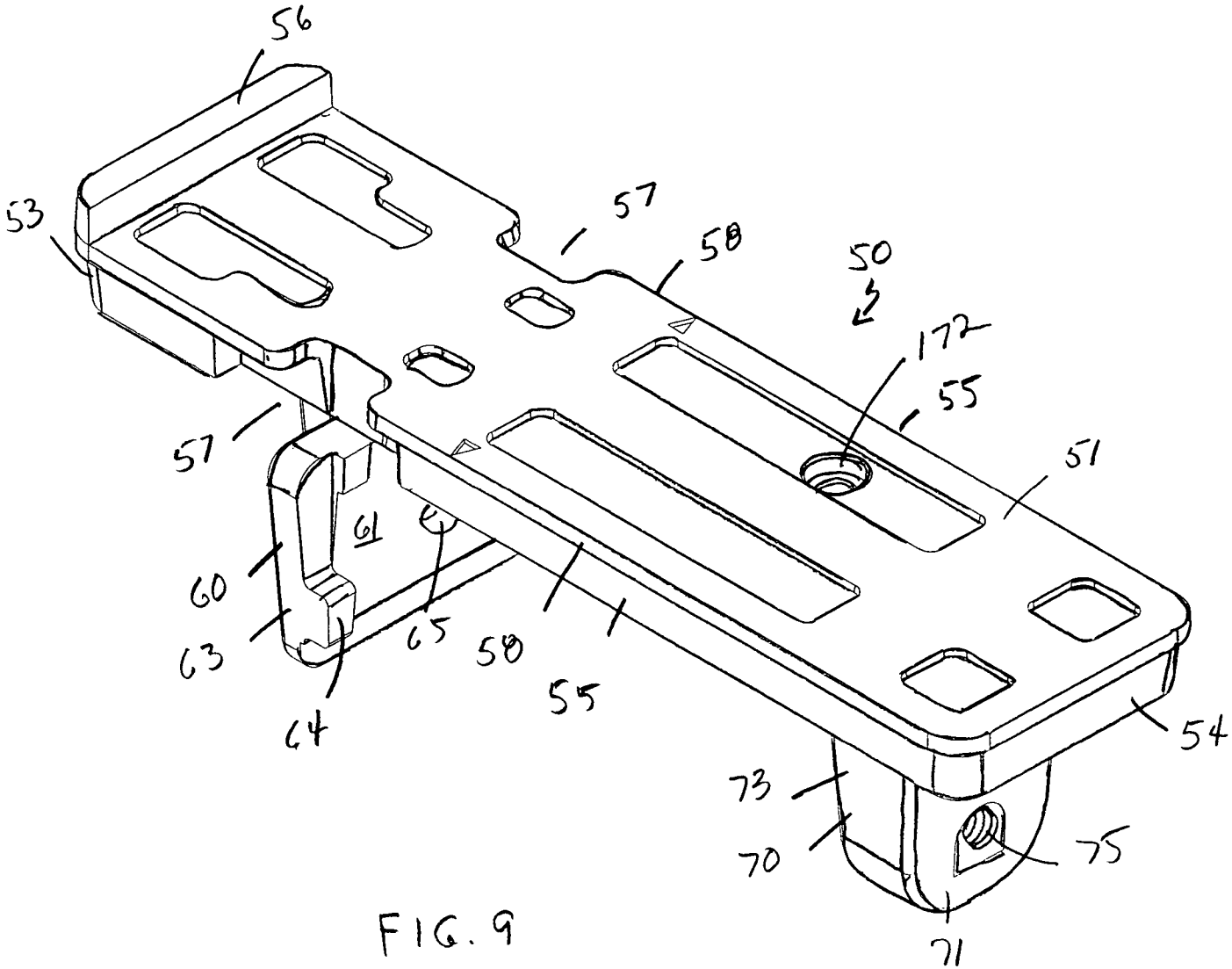
FIG. 9 is a front-top perspective view of a clamping bar.
Figure 10:
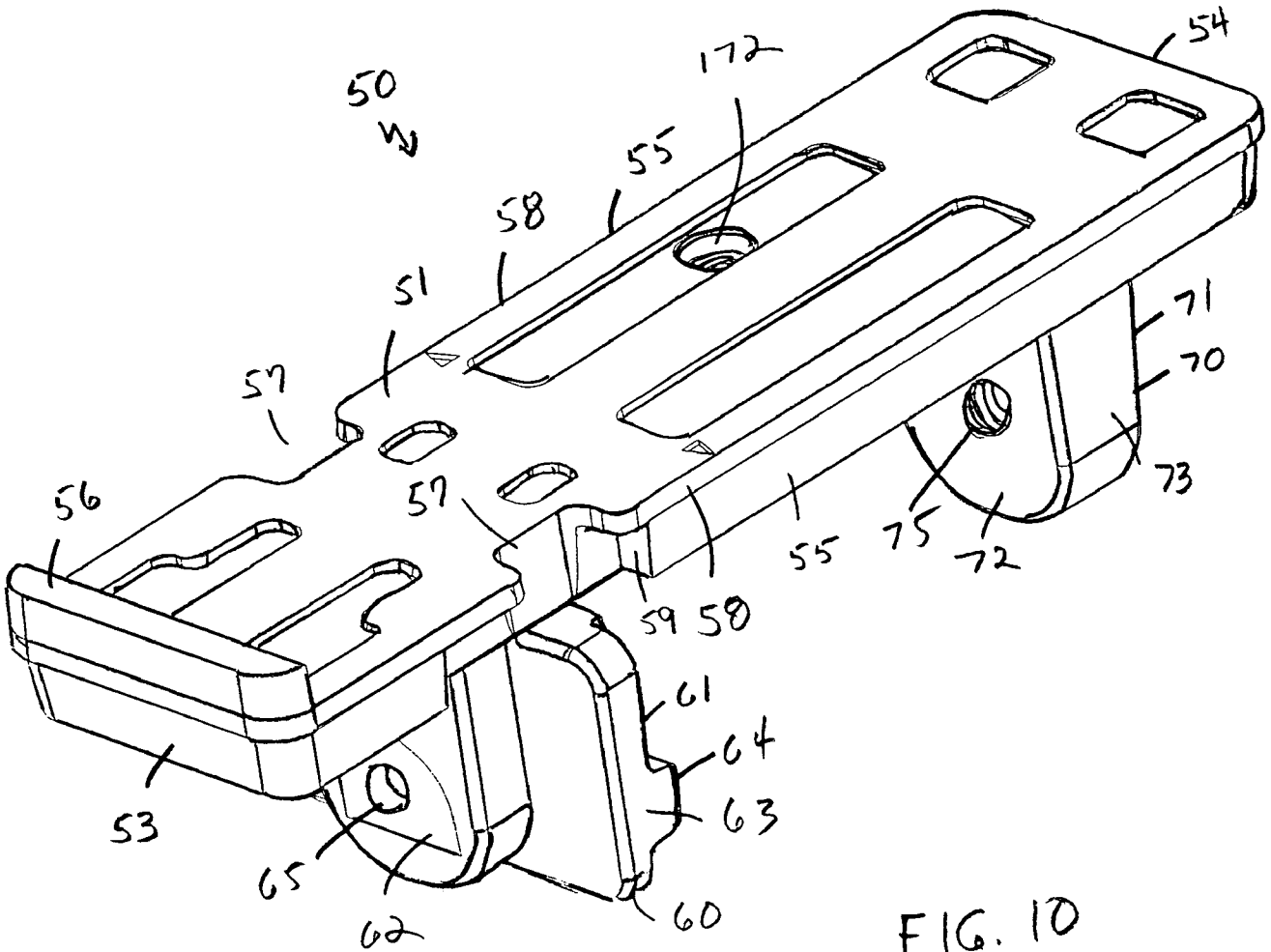
FIG. 10 is a rear-top perspective view of a clamping bar.
Figure 11:
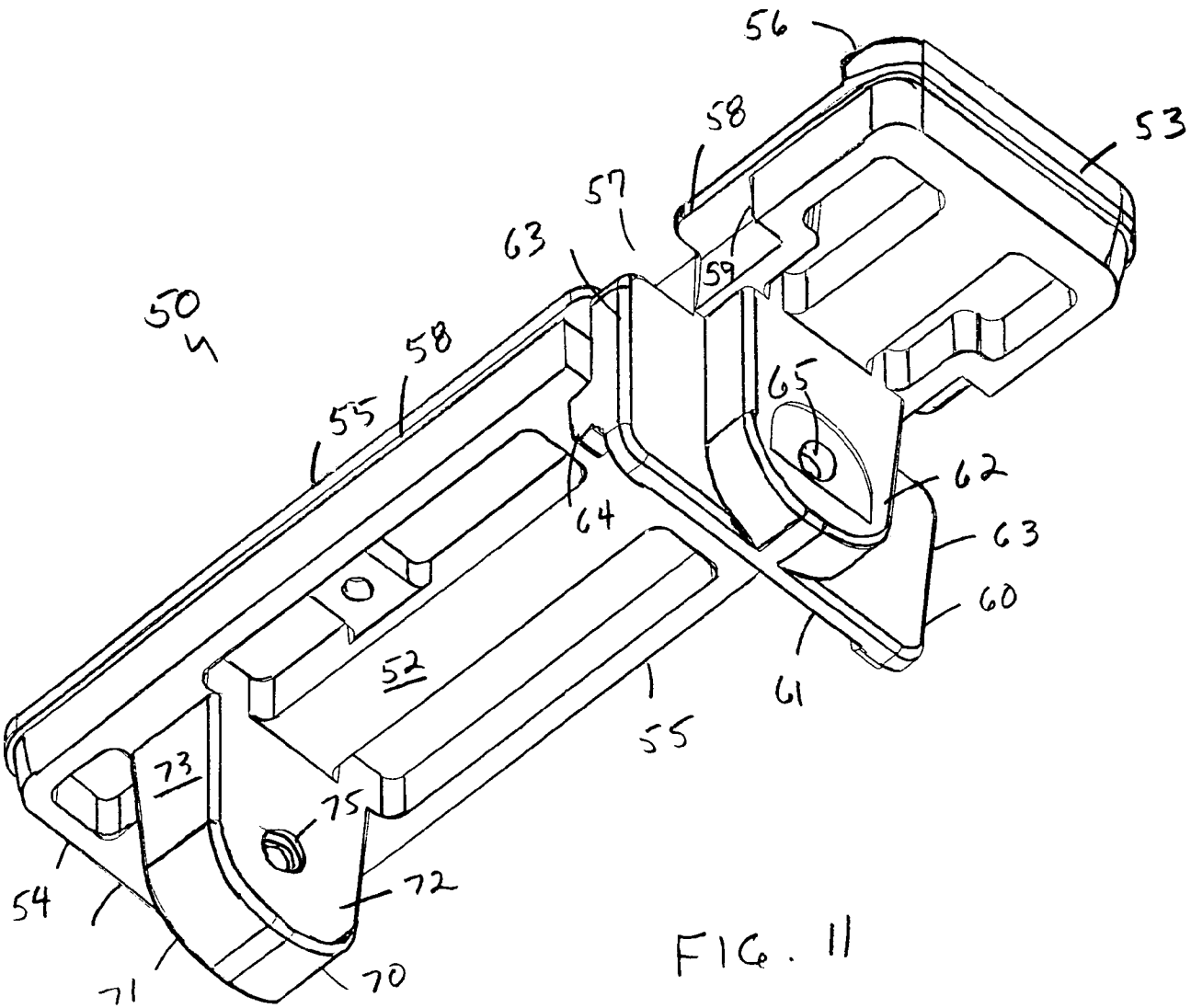
FIG. 11 is a rear-bottom perspective view of a clamping bar.

Referring to the drawings in detail wherein like elements are indicated by like numerals, there is shown in FIG. 1 a box 1 made with four boards dovetailed together at the corners. Boards 2 and 4 terminate at each end in a plurality of pins 3. Boards 5 and 7 terminate at each end in a plurality of tails 6. The box 1 is the result of the four pieces 2, 4, 5, 7 being joined, pins 3 to tails 6, forming a box 1 with four dovetail joints 8. FIGS. 2A and 2B each illustrate two boards, one board end terminating in a plurality of pins 3 and the other board end terminating in a plurality of tails 6. The boards are joined together with the pins inserted into the tails forming a dovetail joint, examples of which are shown in FIG. 1. As may be seen most clearly in FIGS. 2A and 2B, the arrangement of pins and tails for each dovetail joint may have any desired spacing.

Figure 25:
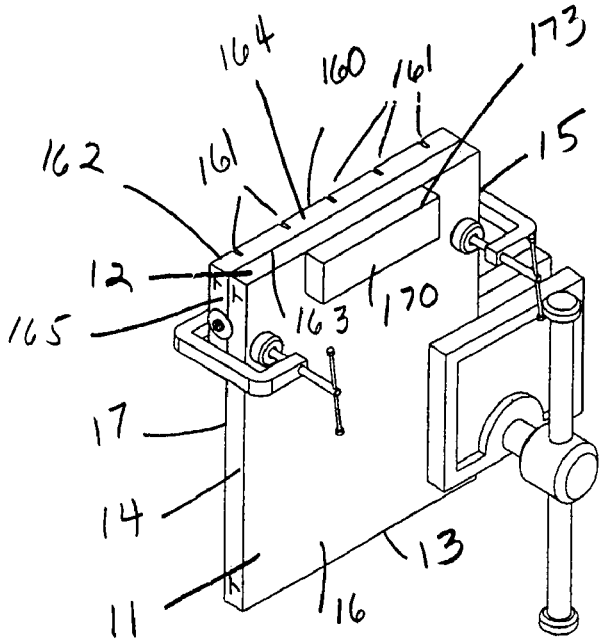
FIG. 25 is a perspective view of a work piece clamped into position and having an index board and front backup board in place.
Figure 26:
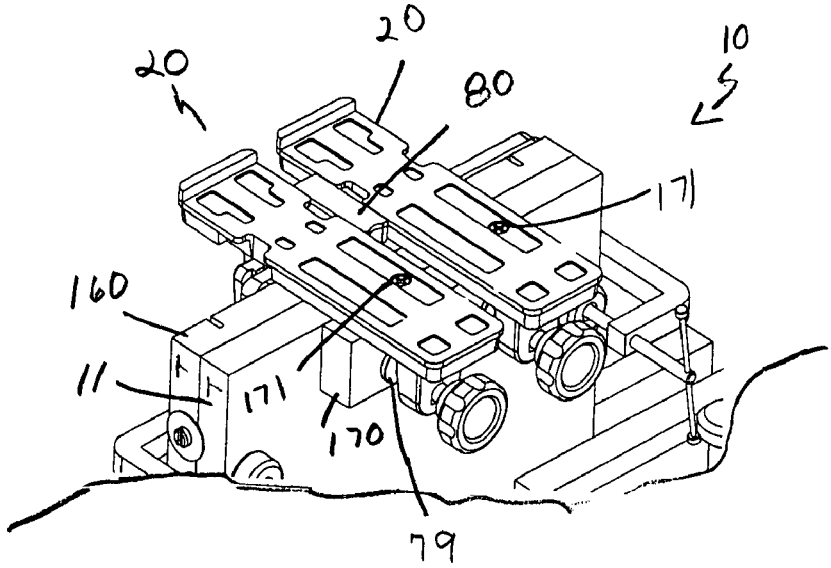
FIG. 26 is a perspective view of the invention jig, setup to make tails, mounted on a work piece.
Figure 27:
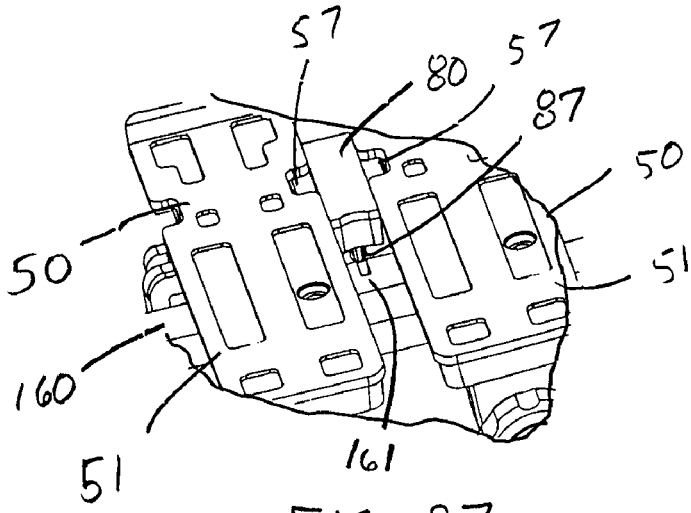
FIG. 27 is a close-up view of the tail insert about to be engaged with an index board groove.
Figure 28:
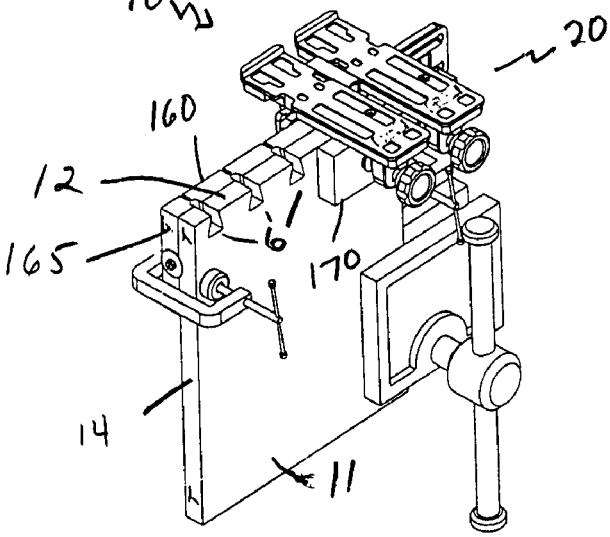
FIGS. 28 and 29 are perspective views of the jig assembly mounted on a work piece with indexing board and front backup board to make tails.
Figure 29:
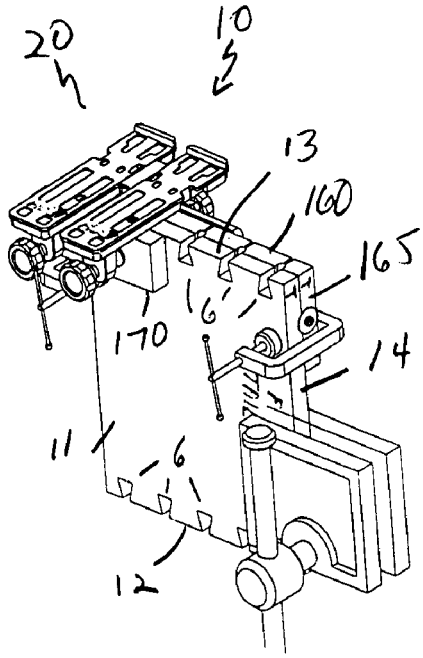

Referring to the remaining drawings there is shown a through dovetail jig assembly 10 comprising a jig 20, two indexing boards 160, front backup board 170, a tail insert 80, and a pin insert 100. The jig assembly 10 is secured to a work piece 11. The work piece 11 is generally a rectangular board having a top end 12, an opposite bottom end 13, a left side 14, an opposite right side 15, a front surface 16 and an opposite rear surface 17. The work piece 11 is typically clamped into a vice or equivalent with the work piece end initially to be worked on horizontally positioned as the top end 12. See FIG. 25. The jig assembly 10 description will be in terms of this preferred orientation.

The assembly jig 20 is comprised of a support base 30 and two clamping bars 50 attached to said support base 30. The jig support base 30 has a generally elongated, rectangular shape, with a top 31, a bottom 32, a left end 33, a right end 34, a front surface 35 and a rear surface 36, said left and right ends defining a jig support base longitudinal axis, said jig support base front and rear surfaces 35, 36 lying in parallel vertical planes, said jig support base top and bottom 31, 32 lying in parallel horizontal planes. The jig support base top 30 has an open rectangular notch 37 formed therein extending from the jig support base front surface 35 to the rear surface 36. The jig support base top notch 37 is positioned to the left of a jig support base longitudinal axis midpoint 38. The jig support base rear surface 36 has an elongated rear channel 39 centrally formed therein, said rear channel extending nearly to the jig support base left end 33 and right end 34, said jig support base rear channel 39 having a longitudinal axis coincident with the jig support base longitudinal axis. The jig support base 30 has a generally cylindrical aperture 40 centrally formed therein and extending from the jig support base front surface 35 through to the jig support base rear surface 36 out through the jig support base rear channel 39. The aperture 40 could have a hexagonal shape as well. The jig support base cylindrical aperture 40 is positioned along the jig support base longitudinal axis to the left of the jig support base top notch 37. The jig support base 30 also has an elongated aperture 41 centrally formed therein and extending from the jig support base front surface 35 through to the jig support base rear surface 36 out through the jig support base rear channel 39. The jig support base elongated aperture 41 has a longitudinal axis coincident with the jig support base longitudinal axis. The jig support base elongated aperture 41 is positioned along the jig support longitudinal axis to the right of the jig support base longitudinal axis midpoint 38 nearly to the jig support base right end 34.

Each jig clamping bar 50 has a generally flat top 51, a bottom 52, a rear end 53, a front end 54, and two opposite, generally parallel, elongated sides 55. The jig clamping bar rear end 53 and front end 54 define a jig clamping bar longitudinal axis. The jig clamping bar longitudinal axis is transverse to the jig support base longitudinal axis. The jig clamping bar top 51 has a horizontal plane perpendicular to the jig support base front surface 35 vertical plane when assembled. The jig clamping bar top 51 terminates in an upwardly extending flange 56 at the clamping bar rear end 53. The jig clamping bar top flange 56 acts as a jig router stop. The clamping bar sides 55 each have a parallel, generally rectangular notch 57 formed therein and extending from the clamping bar top 51 to the clamping bar bottom 52. The clamping bar notches 57 are positioned toward the clamping bar rear end 53. The clamping bar top 51 extends laterally outwardly past and over each clamping bar side 55 forming a top lip 58 over each clamping bar side 55, said clamping bar top lip 58 lying in the said jig clamping bar top horizontal plane. The clamping bar top lip 58 also extend over the forward and rear vertical edges 59 of each clamping bar side notch 57.

Each clamping bar 59 has a downwardly extending, bracing element 60 protruding downwardly from the clamping bar bottom 52 and positioned toward the clamping bar rear end 53 just beneath the side notches 57. The clamping bar bracing element 60 has a flat front wall 61 facing toward the clamping bar front end 54 but having a vertical plane perpendicular to the clamping bar top horizontal plane. The clamping bar bracing element 60 has a rear surface 62 and two opposite sides 63. The clamping bar bracing element front wall 61 has two generally rectangular bracing protrusions 64 formed therein, each bracing protrusion 64 being positioned approximately centrally adjacent a clamping bar bracing element side 63. The clamping element bracing element 60 has a cylindrical aperture 65 formed therein, extending from the clamping element front wall 61 to and through the clamping bar bracing element rear surface 62, said aperture 65 being positioned centrally between said bracing protrusions 64. The clamping bar bracing element cylindrical aperture 65 has a central axis parallel to the clamping bar longitudinal axis.

Each clamping bar 59 also has a downwardly extending, holding element 70 protruding downwardly from the clamping bar bottom 52 and positioned toward the clamping bar front end 54. The clamping bar holding element 70 has a flat front surface 71 facing toward the clamping bar front end 54 but having a vertical plane perpendicular to the clamping bar top horizontal plane, an opposite rear surface 72 and two opposite sides 73. The clamping element holding element 70 has a cylindrical, threaded aperture 75 formed therein, extending from the clamping element front surface 71 to and through the clamping bar holding element rear surface 72, said threaded aperture 75 being positioned centrally in said clamping bar holding element 70. The clamping bar holding element cylindrical, threaded aperture 75 has a central axis parallel to the clamping bar longitudinal axis.

Each clamping bar 50 is positioned with the clamping bar bottom 52 on the jig support base top 31, a left clamping bar 50 between the jig support base left end and adjacent the jig support base top notch 37, and a right clamping bar 51' between the jig support base top notch 37 and jig support base right end 34. Each clamping bar 50 is positioned with the clamping bar bracing element front surface wall 61 facing the jig support base rear surface 36 and the clamping brace holding element rear surface 72 facing the jig support base front surface 35. The clamping bar bracing element protrusions 64 engage the jig support base rear surface rear channel 39. The clamping bars 50, 51' are aligned so that the clamping bar side notches 57 are positioned directly over the jig support base top 31.

Figure 12:
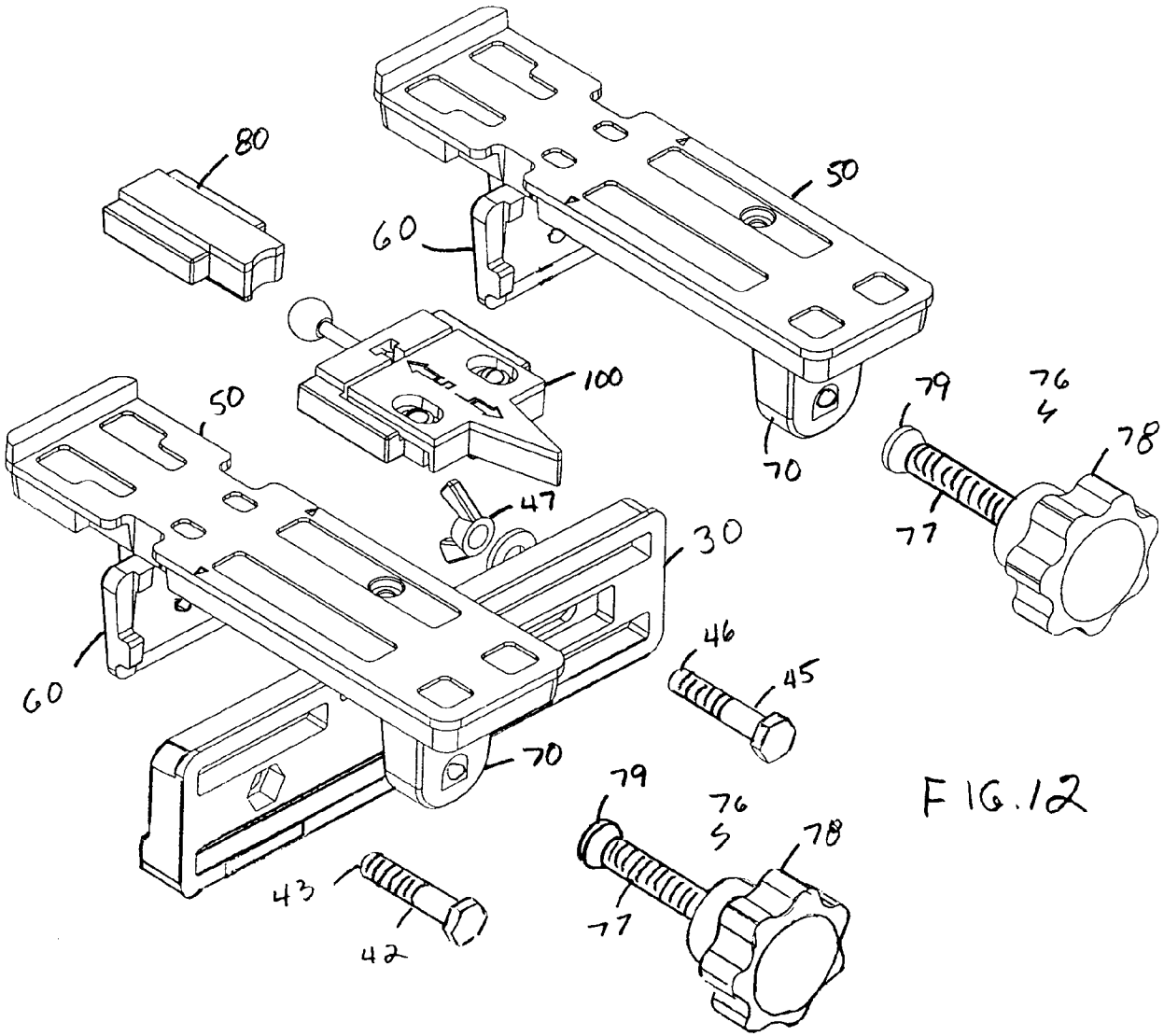
FIG. 12 is a top-front exploded view of the jig with pin and tail cutting inserts.
Figure 13:
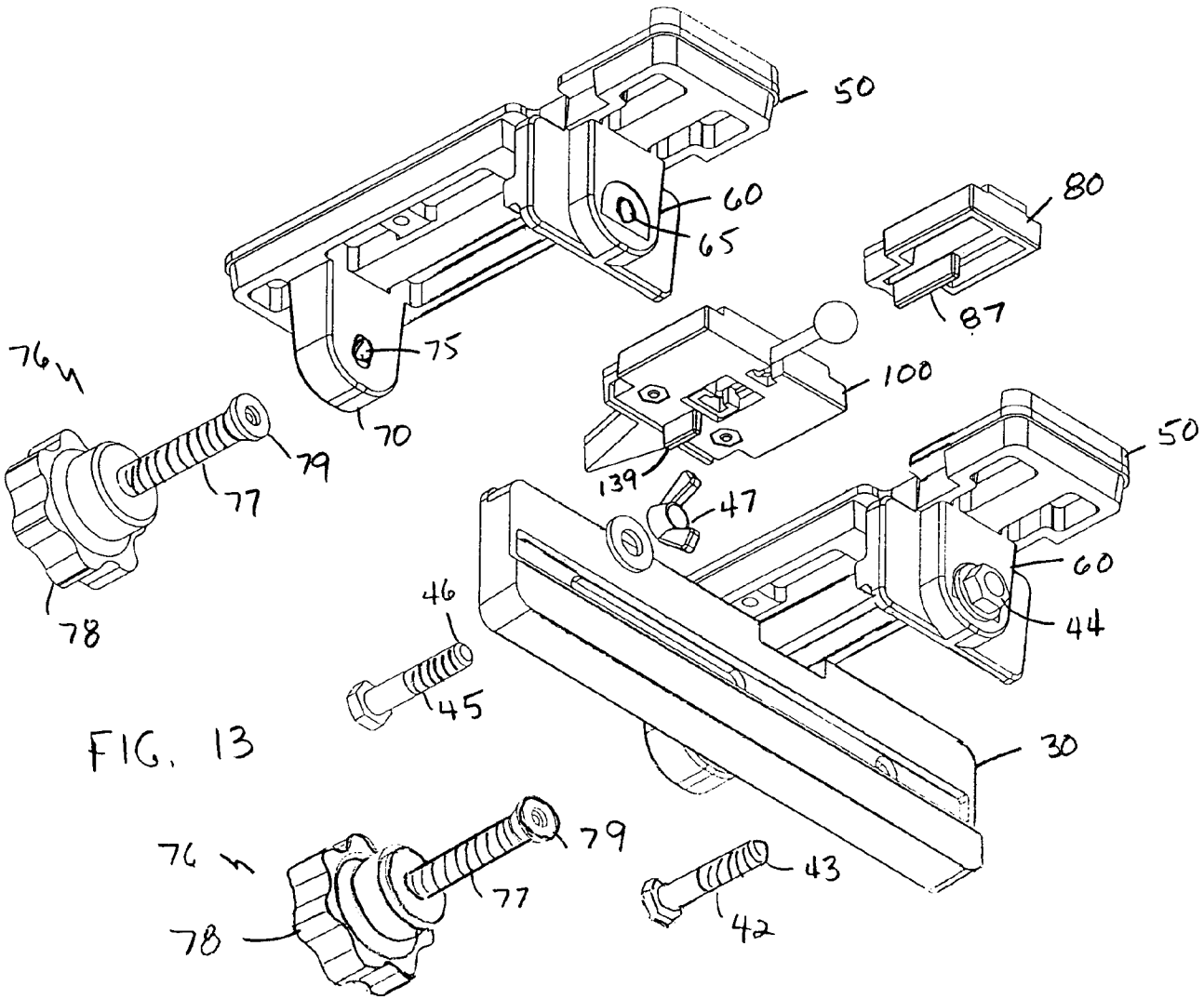
FIG. 13 is a bottom-rear exploded view of the jig with pin and tail cutting inserts.
Figure 14:
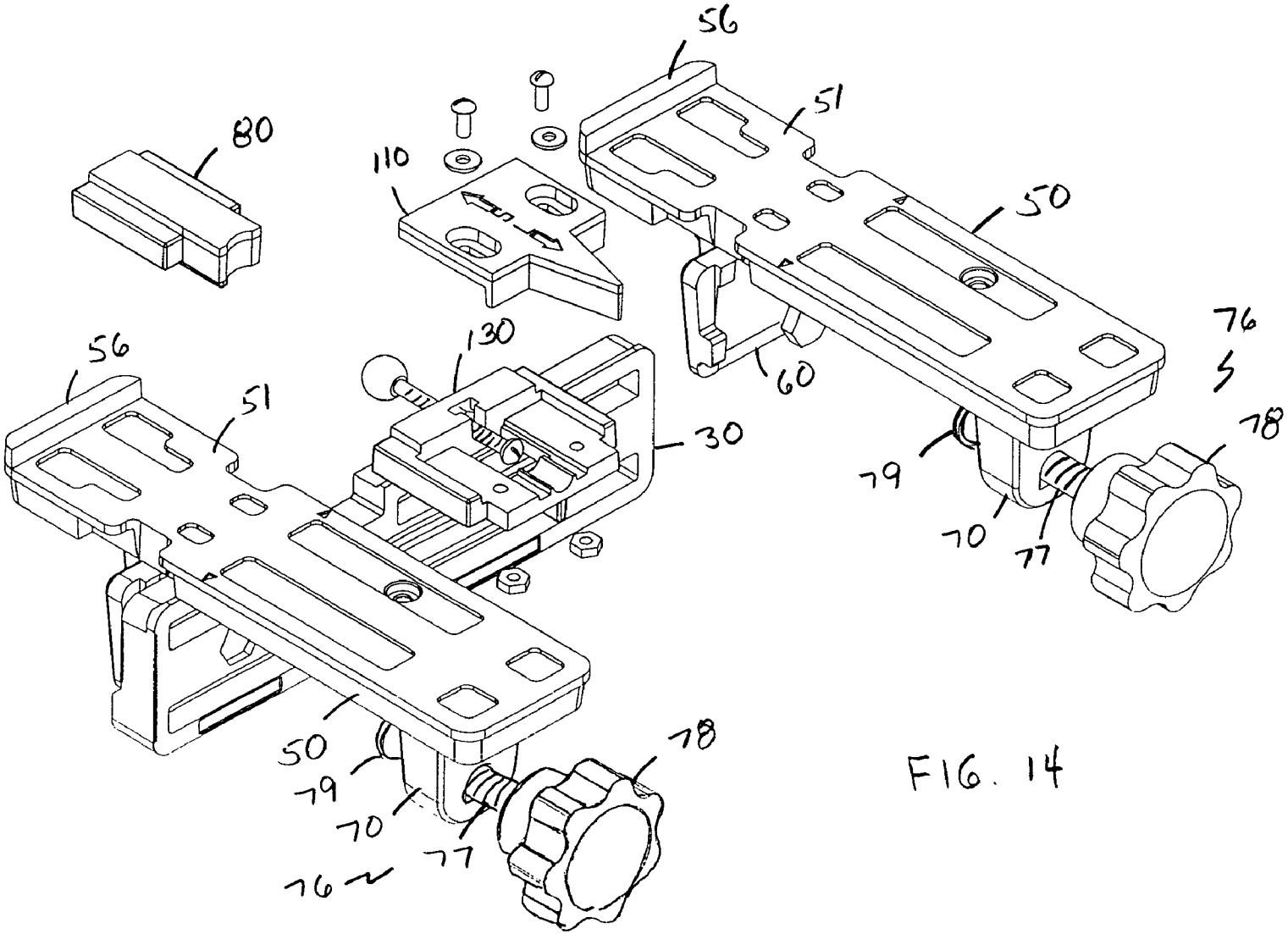
FIG. 14 is the view of FIG. 12, partly assembled.

Referring more particularly to FIGS. 12 and 13, the clamping bar designated as the left clamping bar 50 has a threaded bolt 42 inserted into the jig support base cylindrical aperture 40 from the jig support front surface 35 through the clamping bar bracing element aperture 65, wherein a portion 43 of the threaded bolt 42 protrudes through and past the jig support rear surface 36. A nut 44 engages the threaded bolt protruding portion 43 thereby bracing the clamping bar 50 to the jig support base 30. The clamping bar designated as the right clamping bar 50' has a second threaded bolt 45 inserted into the jig support base elongated aperture 41 from the jig support front surface 35 through the clamping bar bracing element aperture 65, wherein a portion 46 of the second threaded bolt 45 protrudes through and past the jig support rear surface 36. A wing nut 47 engages the threaded bolt protruding portion 46 thereby adjustably bracing the right clamping bar 50' to the jig support base 30. The left clamping bar 50 is in a fixed position within the jig 20. The right clamping bar 50' is laterally adjustable.

Both clamping bars 50, 50' have a holding element 76 inserted through the clamping bar holding element threaded aperture 75. Each holding element 76 is comprised of a threaded rod 77 adapted to engage the threaded aperture 75 of the clamping bar holding element 70. The proximal end of the holding element 76 terminates in a knob 78 adapted to manually manipulate the threaded rod 77. The distal end of the holding element terminates in a clamping foot 79.

Figure 15:
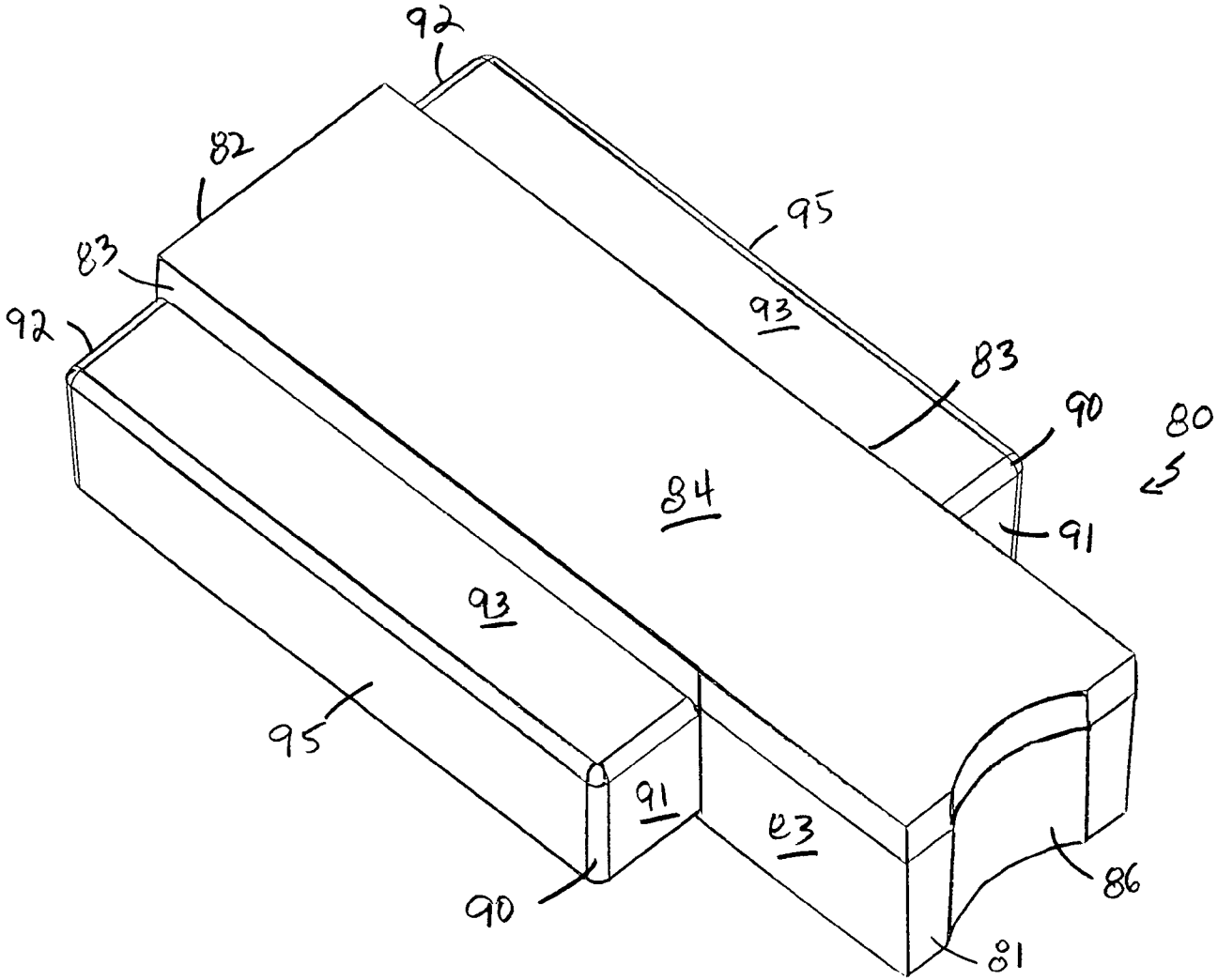
FIG. 15 is a top perspective view of the tail insert.
Figure 16:
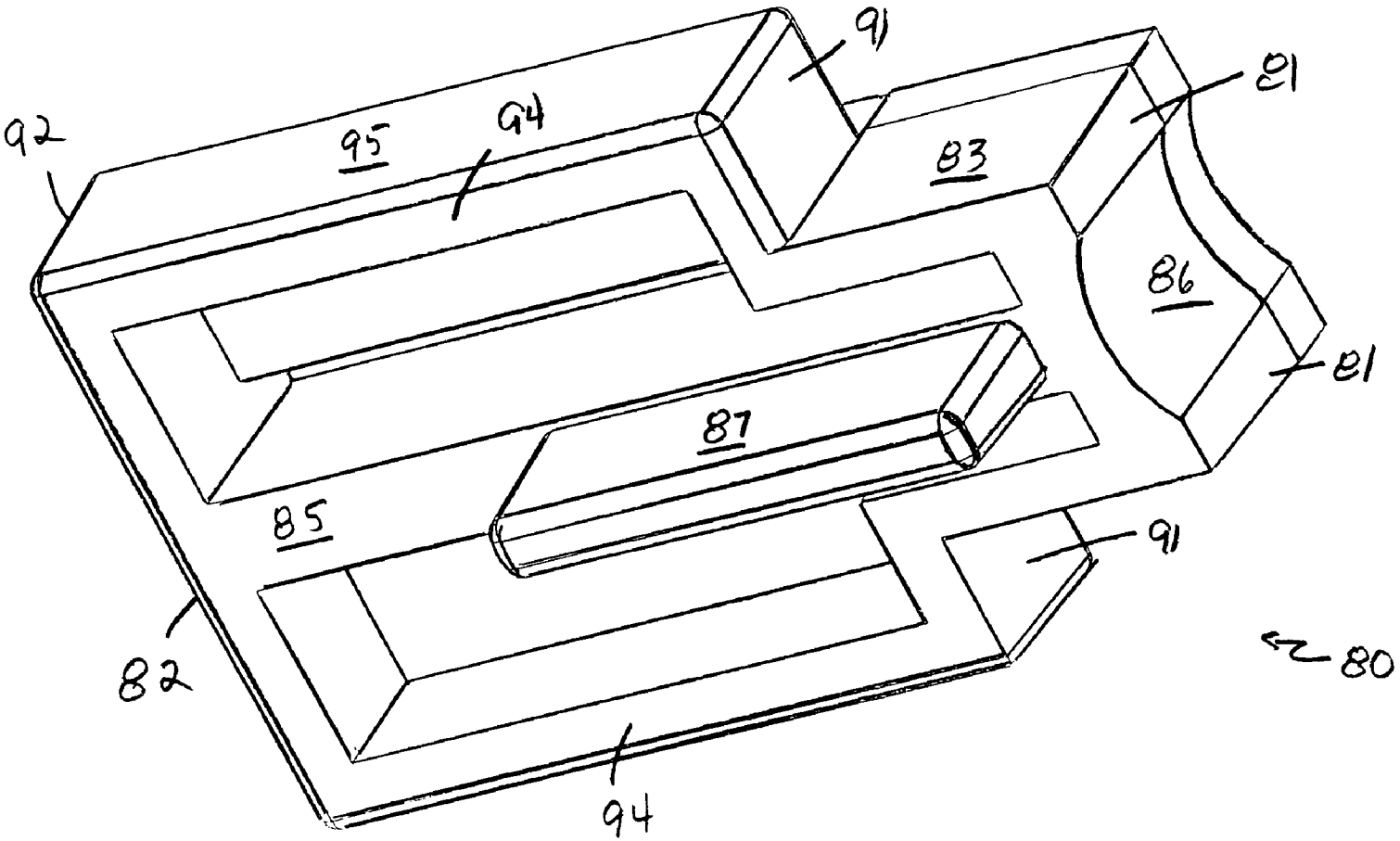
FIG. 16 is a bottom perspective view of the tail insert showing the indexing tab.

Referring more particularly to FIGS. 15 and 16, there are shown top and bottom perspectives of the tail insert 80. The tail insert 80 has a front 81, a rear 82, two opposite sides 83, a flat top 84, and a bottom 85, said front and rear defining a tail insert longitudinal axis. The tail insert front 81 has a rounded channel 86 formed therein and extending from the tail insert bottom 85 to the tail insert top 84. An elongated, indexing tab 87 protrudes centrally downward from the tail insert bottom 85 extending from a point rearward of the front channel 86 a desired distance toward the tail insert rear 82. The indexing tab 87 has a longitudinal axis parallel to the tail insert longitudinal axis. The cross section of the indexing tab 87 is tapered intentionally so that it can fit snugly into slot widths that might vary.

The tail insert 80 has a rectangular block 90 formed laterally on each side 83. Each lateral block 90 has a front 91, a rear 92, a top 93, a bottom 94, and a free side 95, said lateral block front and rear defining a lateral block longitudinal axis which is parallel to the longitudinal axis of the tail insert. Each lateral block front 91 is offset rearwardly from the tail insert front 81. Each lateral block top 93 is offset downwardly from the tail insert top 84. Each tail insert lateral block 90 is adapted to fit into a clamping bar side notch 57 beneath the clamping bar top lip 58 wherein a clamping bar top lip 58 engages a lateral block top 93. The tail insert indexing tab 87 fits into the jig support base top notch 37. The jig support base top notch 37 is defined to provide clearance for the indexing tab 87.

Referring more particularly to FIGS. 17 through 22, there is shown a pin insert 100 constructed according to the present invention. The pin insert is comprised of a pin insert guide 110 connected to a pin insert adjustment base 130. The pin insert guide 110 has a flat, rectangular top 111, a bottom 112, a front 113, a rear 114, and two parallel, opposite sides 115. The pin insert guide front 113 protrudes downwardly past the pin insert guide bottom 112 a desired amount. Protruding forwardly from the pin insert guide front 113 is a horizontal, V-shaped element 116 terminating in a forward, vertical apex 117. The V-shaped element vertical apex 117 and pin insert rear 114 defining a pin insert guide longitudinal axis. Two counterbored, elongated apertures 118 are formed in the pin insert guide top 111, extending through to the pin insert bottom 112. The top elongated apertures 118 are each positioned proximate a pin insert guide side 115 and each have a longitudinal axis parallel to the pin insert guide longitudinal axis.

The pin insert guide bottom 112 has a generally rectangular adjustment chamber 120 extending downwardly from a pin insert guide central, longitudinal axis. The pin insert bottom adjustment chamber 120 has a forward wall 121, a rearward wall 122, two opposite sides 123 and an open bottom 124. The pin insert guide bottom 112 forms an adjustment chamber top. The adjustment chamber rearward wall has a vertical aperture 125 formed centrally therein. See FIGS. 21 and 22.

The pin insert adjustable base 130 has a front 131, a rear 132, two opposite, parallel sides 133, a top 134 and a bottom 135, said front and rear defining a pin insert adjustable base longitudinal axis. A generally rectangular opening 137 is formed centrally in the pin insert adjustable base 130 extending from the pin insert adjustable base top 134 through the base bottom 135. Said central opening 137 is adapted to receive the pin insert guide adjustment chamber 120. A horizontal aperture 138 is formed in the pin insert adjustment base rear 132 along an adjustment base central, longitudinal axis opening into said pin insert adjustment base central opening 137. The adjustment base top 134 is forwardly stepped downward to two flat platforms 140 on each side of the central opening 137. A circular aperture 136 is formed in each platform 140 extending through to the pin insert adjustable base bottom 135. The circular apertures 136 are positioned proximate the pin insert adjustable base sides 133. A semi-circular channel 141 is formed in the adjustment base top 134 between the platforms 140 and between the central opening 137 and adjustment base front 131. The channel 141 has a longitudinal axis coincident with an adjustment base central longitudinal axis.

The pin insert adjustment base 130 has a rectangular block 150 formed laterally on each side 133. Each lateral block 150 has a front 151, a rear 152, a top 153, a bottom 154, and a free side 155, said lateral block front and rear defining a lateral block longitudinal axis which is parallel to the longitudinal axis of the pin insert adjustment base. Each lateral block front 151 is offset rearwardly from the pin insert adjustment base front 131. Each lateral block top 153 is offset downwardly from the pin insert adjustment base top 134 but above the platforms 140. There is a portion 156 of the lateral block side, opposite of the free side 155, which is exposed above the platform 140. Each pin insert adjustment base lateral block 150 is adapted to fit into a clamping bar side notch 57 beneath the clamping bar top lip 58 wherein a clamping bar top lip 58 engages a lateral block top 153. The pin insert adjustment base indexing tab 139 fits into the jig support base top notch 37.

An adjustment bolt 101 is inserted into the pin insert adjustment base rear horizontal aperture 138 wherein the adjustment bolt 101 has a head 102 positioned over the adjustment base opening 137. The adjustment bolt threaded shaft 103 threadingly engages a nut 104 held in a holding chamber 142 formed in the adjustment base top 134 through to the adjustment base bottom 135. The adjustment bolt threaded shaft 103 extends rearward past the adjustment base rear 132 and terminates in a ball 105.

An elongated, indexing tab 139 protrudes centrally downward from the pin insert adjustment base bottom 135 extending from the pin adjustment base front 131 to the pin adjustment base central opening 137. The indexing tab 139 has a longitudinal axis parallel to the pin insert adjustment base central longitudinal axis and has a tapered cross section like the tail insert indexing tab 87. The adjustment base circular apertures 136 open onto two nut holes 143 in the adjustment base bottom 135, said nut holes 143 shaped to hold a nut circumferentially in place.

Figure 17:
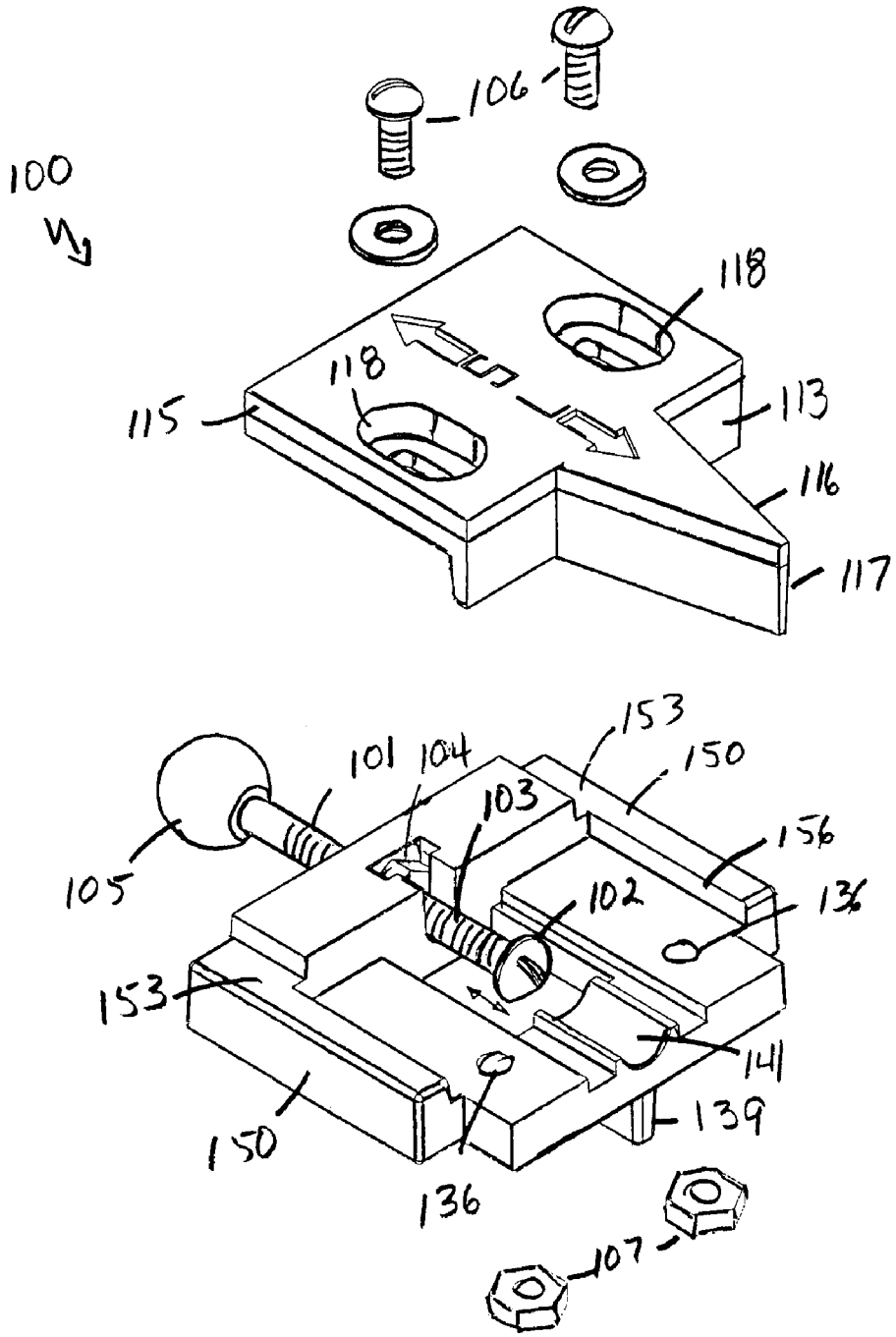
FIG. 17 is a top exploded view of the pin insert.
Figure 18:
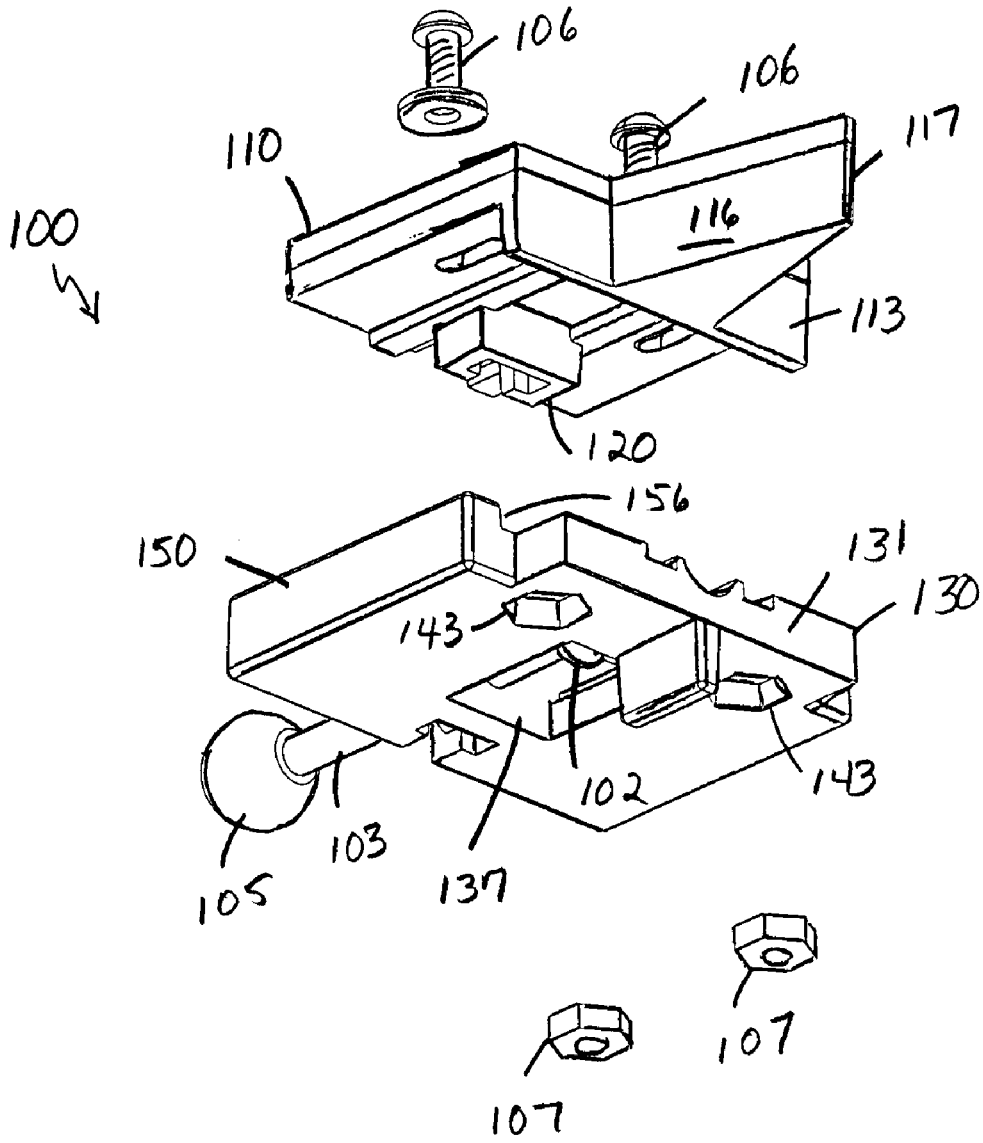
FIG. 18 is a bottom exploded view of the pin insert showing the indexing tab.
Figure 19:
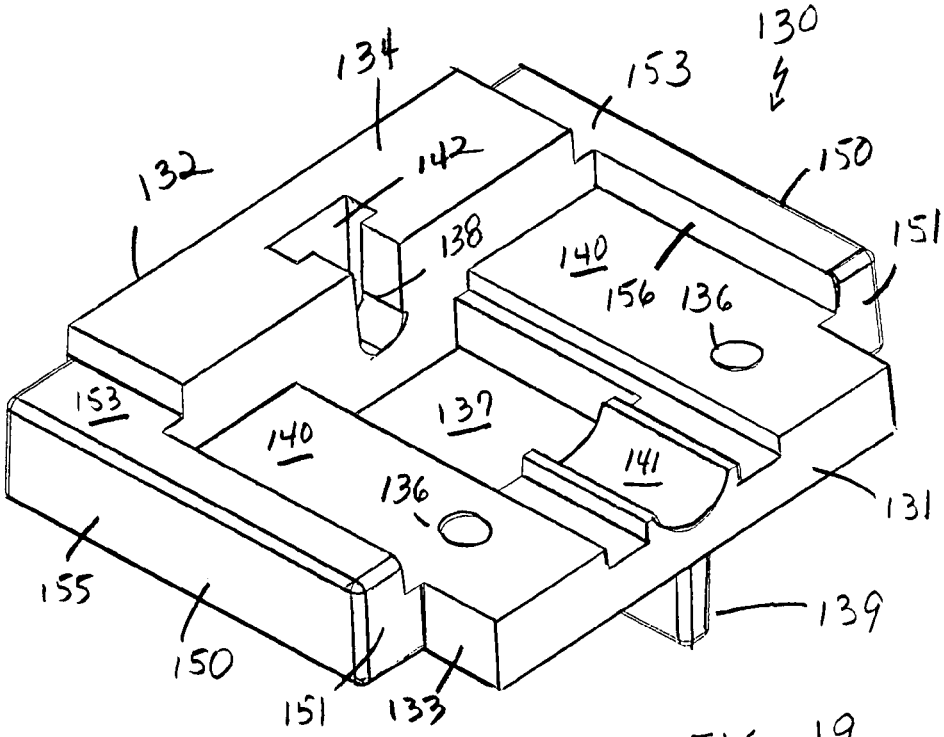
FIG. 19 is a top perspective view of the pin insert adjustment base.
Figure 20:
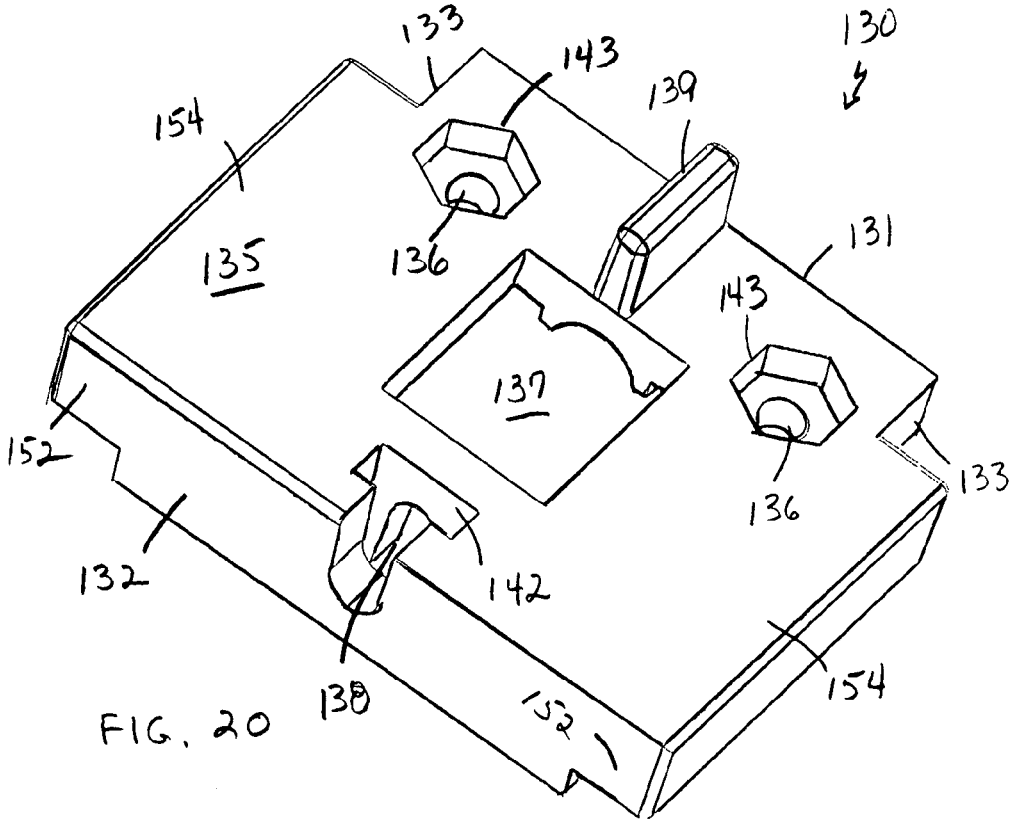
FIG. 20 is a bottom perspective view of the pin insert adjustment base showing the indexing tab.
Figure 21:
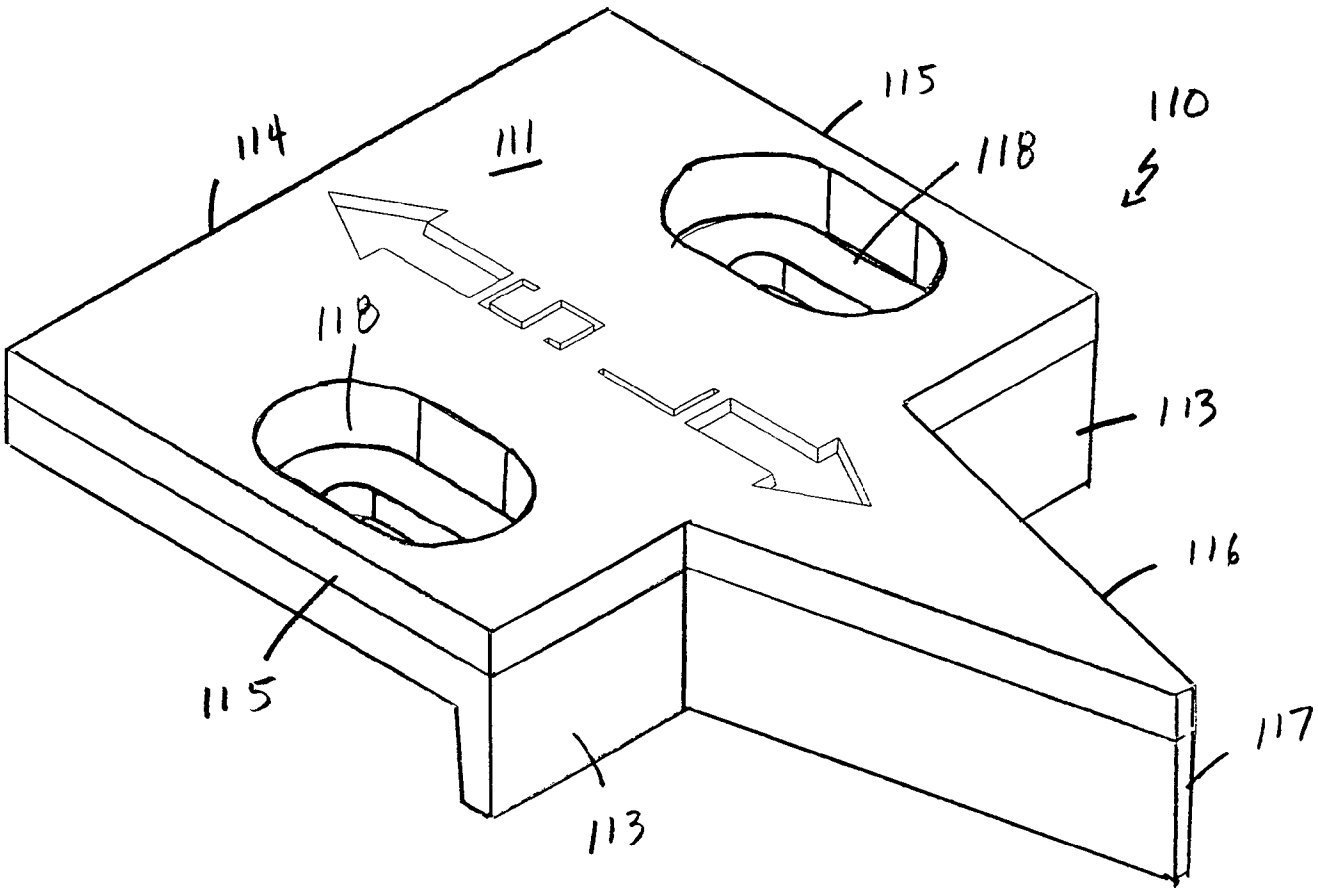
FIG. 21 is a top perspective view of the pin insert guide.
Figure 22:
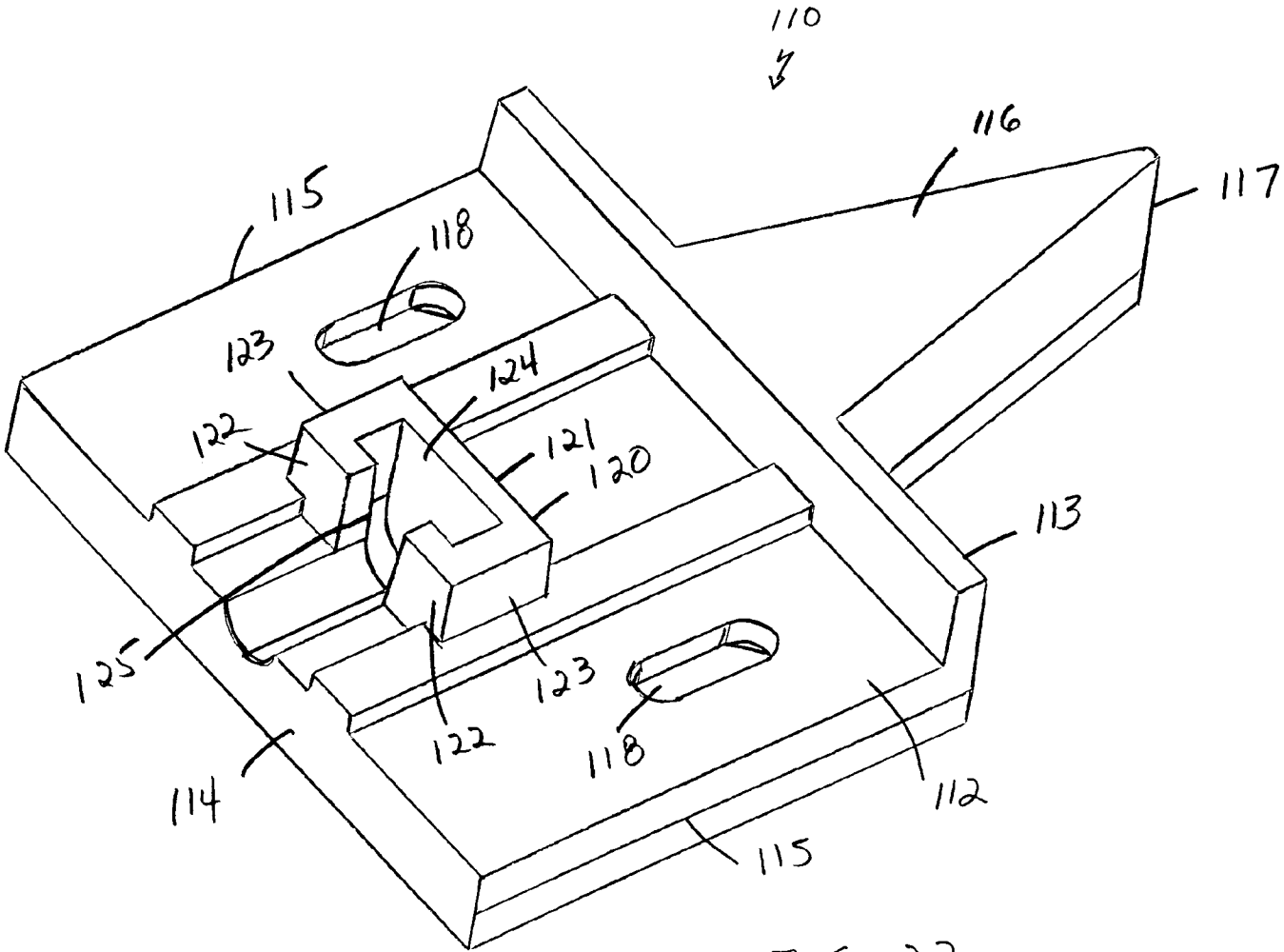
FIG. 22 is a bottom perspective view of the pin insert guide.

Referring more particularly to FIGS. 17 and 18, the pin insert guide 110 is joined to the pin insert adjustment base 130 by placing the pin insert guide 110, bottom 112 first, onto the adjustment base platforms 140. The pin insert guide front 113 overlaps the adjustment base front 131. The pin insert guide sides 115 abut the pin insert adjustable base rectangular block exposed side portions 156. The pin insert guide adjustment chamber 120 fits over the pin insert adjustable base threaded adjustment bolt head 102 wherein the bolt shaft 103 protrudes through the adjustment chamber rearward wall vertical aperture 125. The pin insert guide 110 is held to the pin insert adjustable base 130 by means of two threaded fasteners 106 inserted through the pin insert guide top apertures 118 and through the pin insert adjustable base platform apertures 136. A threaded nut 107 engages the threaded fastener 106 in each of the nut holes 143 in the pin insert adjustable base bottom 135.

Figure 23:
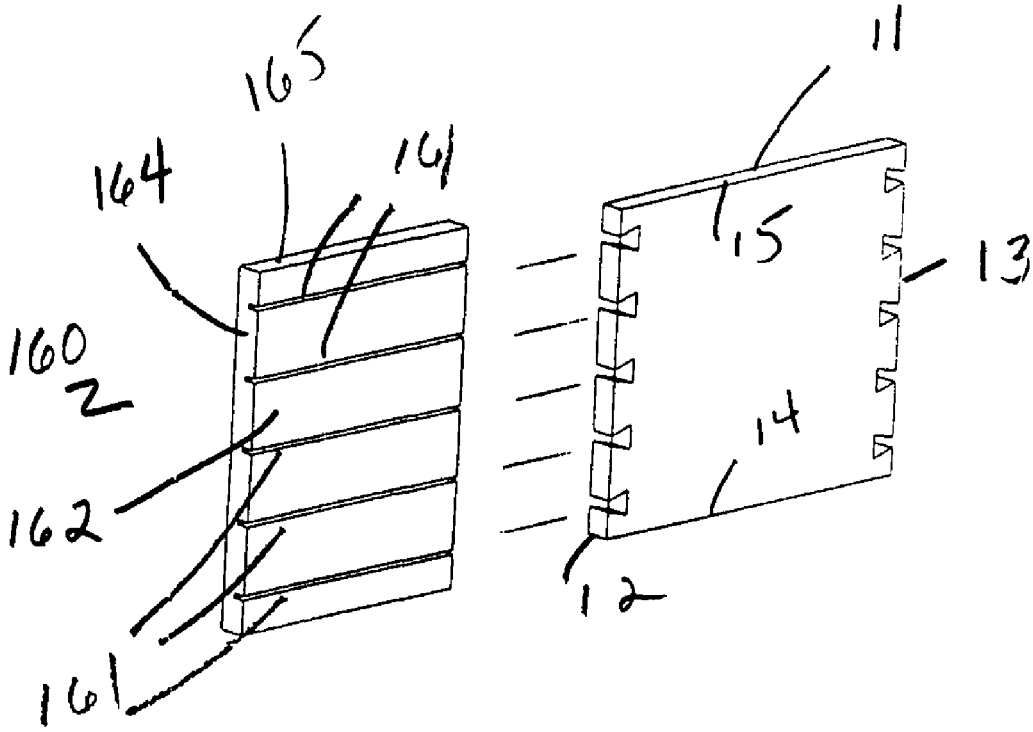
FIG. 23 is a front perspective view of an indexing board aligned with a work piece.
Figure 24:
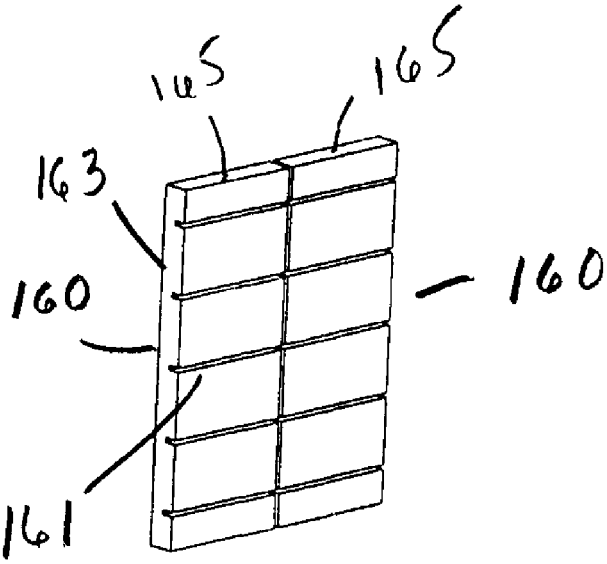
FIG. 24 is a front perspective view of two indexing boards.

Referring more particularly to FIGS. 23 and 24, the dovetail jig assembly indexing boards 160 are each comprised of a rectangular board having a plurality of parallel grooves 161 formed along one surface 162. The indexing boards 160 are formed by cutting the grooves in a single board, said parallel grooves 161 representing the spacing of a desired dovetail arrangement. The grooves 161 are easily formed by saw cuts. See FIG. 23. To form the two indexing boards, the grooved single board is ripped in half. See FIG. 24.

The front backup board 170 is a generally rectangular piece positioned in front of the work piece 11 having a long side adjacent the work piece top 12. The front backup board is adapted to being held in place by means of a fastener 171 inserted through an aperture 172 in each clamping bar top 51 into a backup board top edge 173. The front backup board 170 reduces splintering when the actual cutting process takes place.

Referring more particularly to FIGS. 25 through 34, the work piece 11 is sandwiched between the front backup board 170 and an index board 160, said index board having the grooves 161 vertically aligned and facing away from the work piece. See FIG. 25. The jig 20 is positioned over the work piece top 11 with the jig support base front surface 35 adjacent the grooved surface of the index board 160. The holding element 76 is positioned against the front backup board 170 so that the holding element clamping foot 79 directly engages the front backup board 170. The tail insert indexing tab 87 or pin insert adjustment base indexing tab 139 engages one of the indexing board grooves 161. The jig support base top notch 37 simply provides clearance for the indexing tabs.

Figure 35A:
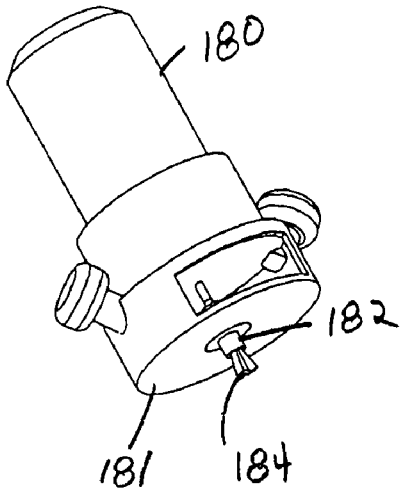
FIG. 35A is a perspective view of a typical router with a dovetail cutting bit used for making tails.
Figure 35B:
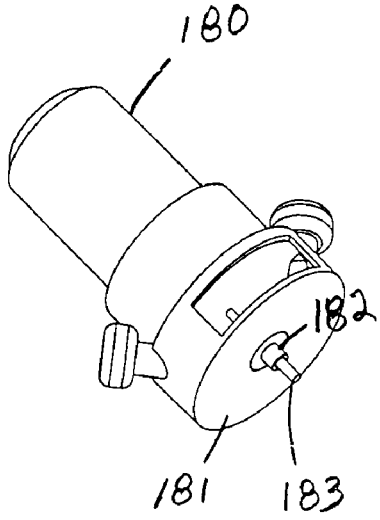
FIG. 35B is a perspective view of a typical router with a straight bit used for making pins.

The jig 20 is used with a router 180. The router base 181 rests on the clamping bar flat tops 51 and the router cutting bit 183 fits between the parallel clamping bars 50. The clamping bar top rear flanges 56 provide a router stop function. The inserts 80 (for tails) and 100 (for pins) provide physical guidance to the router follower collar 182 through which the router cutting dovetail (trapezoidal shape) bit 184 for tails or straight bit 183 for pins protrudes. See FIGS. 35A and 35B.

Operationally, the first step in using the through dovetailing jig assembly 10 of the present invention, is the preparation of indexing boards 160. The workpiece top 12 is marked with the desired locations for tails and pins. One indexing board end 165 is marked for identification. A generally rectangular board 160 is then aligned with the workpiece top markings and marked as well. A number of parallel grooves 161, corresponding to the markings, is formed across one face of the board. See FIG. 23. The grooved board is then cut, transversely to the grooves, into two boards, thereby forming two indexing boards 160, a first indexing board and a second indexing board, both of which are identical. See FIG. 24. The grooved board could be cut into more than two pieces if extra indexing boards were required.

The next step is to make a workpiece with tails. To do this, the first indexing board 160 is clamped to the workpiece 11 so that the indexing board non-grooved surface 163 is against the workpiece rear surface 17 and the indexing board marked end 165 is adjacent the workpiece left side 14. The workpiece left side 14 is marked and corresponds to the indexing board marked end 165. The indexing board 160 is oriented so that the grooves 161 are positioned vertically. An indexing board edge 164 is aligned with the workpiece top 12. The front backup board 170 is aligned with the workpiece top 12 against the workpiece front surface 16. See FIG. 25.

The jig 20 is configured with the tail insert 80 and then mounted on the workpiece top 12. The tail insert indexing tab 87 is positioned in an indexing board groove 161. The jig support base front surface 35 abuts the indexing board grooved surface 162. Each clamping bar holding element, clamping foot 79 abuts the backup board 170. See FIG. 26. Two fasteners 171 may be inserted through the clamping bar top apertures 172 to hold the front backup board 170 in place.

The router 180 is then placed on the clamping bar tops 51 with the router base 181 resting on the clamping bar tops 51 and the follower 182 with protruding dovetail bit 184 positioned between the clamping bars 50, 50'. The router 180 is turned on and moved toward the tail insert 80 cutting through the backup board 170, through the workpiece top 12 forming a tail 6, and into the indexing board non-grooved surface 163. This is the only time that the backup board 170 has to be cut. The tail insert 80 acts as a router stop halting the rearward movement of the router 180. The indexing board 160 also acts as a rear backup board reducing splintering. The router 180 is then turned off and removed. The jig 20 is then moved and set into an adjacent indexing board groove 161. This operation is repeated until the end of the board is completed. See FIG. 28.

Figure 30:
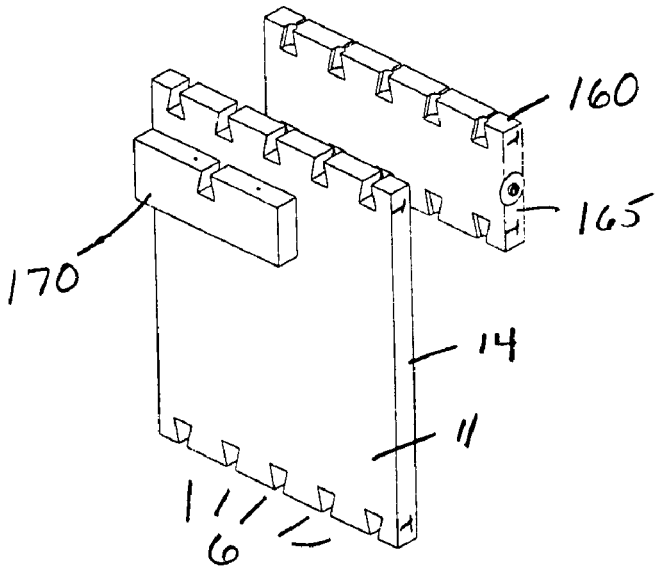
FIG. 30 is a perspective view of a work piece, indexing board and backup board after the tail making operation is completed.
Figure 31:
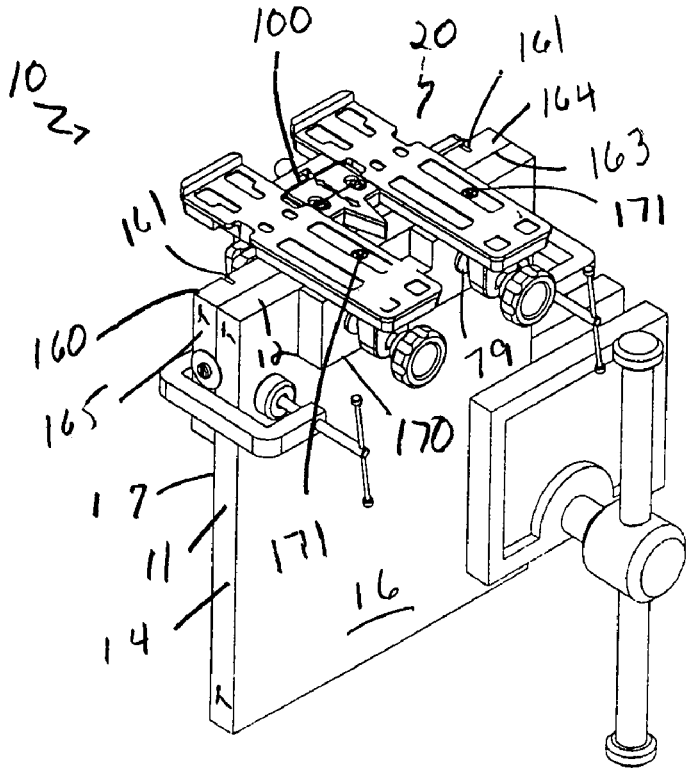
FIG. 31 is a perspective view of the invention jig, setup to make pins, mounted on a work piece.
Figure 32:
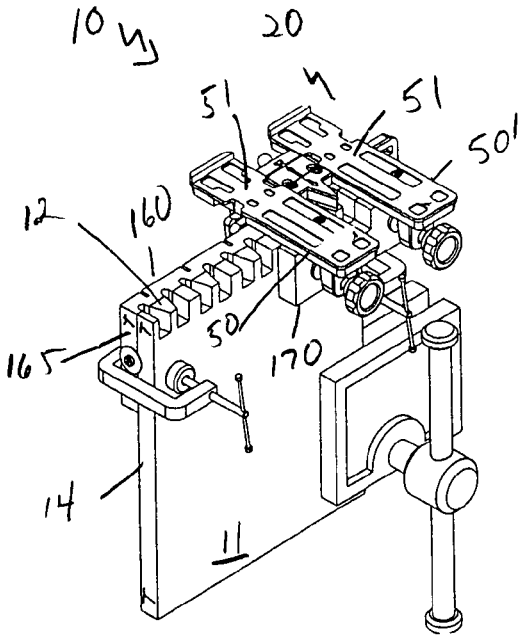
FIGS. 32 and 33 are perspective views of the jig assembly mounted on a work piece to make pins.
Figure 33:
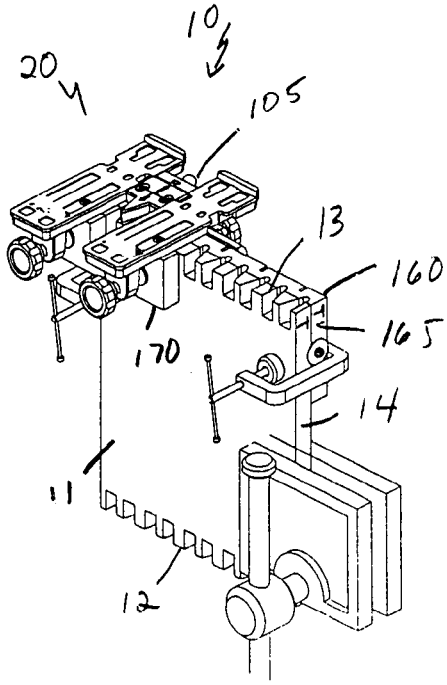

The tail cutting operation is then performed on the workpiece bottom end 13. The workpiece 11 is flipped so that the bottom end 13 is the new top end, and the original left side is now the right side. The indexing board 160 is clamped to the workpiece new top (previous unfinished bottom) as in the first operation. The indexing board marked end 165 is positioned adjacent the workpiece marked end (previous left end). The tail cutting operation is then repeated. See FIG. 29. FIG. 30 illustrates the three boards, i.e., indexing board 160, workpiece 11, and backup board 170, after the tail cutting operation is completed on both ends.

The next step is to make a workpiece with pins. The router dovetail bit 184 is replaced with a straight bit 183. The second indexing board 160, which is perfectly matched to the first indexing board, is then clamped to a workpiece 11 so that the indexing board non-grooved surface 163 is against the workpiece rear surface 17 and the indexing board marked end 165 is adjacent the workpiece left side 14. The workpiece left side 14 is marked and corresponds to the indexing board marked end 165. The index board 160 is oriented so that the grooves 161 are positioned vertically. An indexing board edge 164 is aligned with the workpiece top 12. The front backup board 170 is aligned with the workpiece top 12 against the workpiece front surface 16. See FIG. 25.

The jig 20 is configured with the pin insert 100 and then mounted on the workpiece top 12. The pin insert adjustment base indexing tab 139 is positioned in an indexing board groove 161. The jig support base front surface 35 abuts the indexing board grooved surface 162. Each clamping bar holding element, clamping foot 79 abuts the backup board 170. See FIG. 31. Two fasteners 171 may be inserted through the clamping bar top apertures 172 to hold the front backup board 170 in place.

The router 180 is then placed on the clamping bar tops 51 with the router base 181 resting on the clamping bar tops 51 and the follower 182 with protruding straight bit 183 positioned between the clamping bars 50, 50'. The router 180 is turned on and moved toward the pin insert 100 cutting through the backup board 170, through the workpiece top 12 forming a pin, and into the indexing board non-grooved surface 163. Again, the backup board 170 does not have to be cut again. The pin insert vertical apex 117 provides a pin shape and acts as a router guide and stop to the rearward movement of the router 180. The indexing board 160 also acts as a rear backup board reducing splintering. The router 180 is then turned off and removed. The jig 20 is then moved and set into an adjacent indexing board groove 161. This operation is repeated until the end of the board is completed. See FIG. 32.

Figure 34:
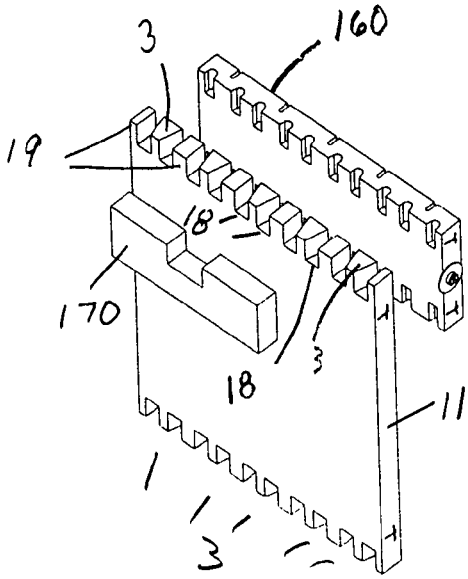
FIG. 34 is a perspective view of a work piece after the pin making operation is completed.

The pin cutting operation is then performed on the workpiece bottom end 13. The workpiece 11 is flipped so that the bottom end 13 is the new top end, and the original left side is now the right side. The indexing board 160 is clamped to the workpiece new top (previous unfinished bottom) as in the first operation. The indexing board marked end 165 is positioned adjacent the workpiece marked end 14 (previous left end). The pin cutting operation is then repeated. See FIG. 33. FIG. 34 illustrates the three boards, i.e., indexing board 160, workpiece 11, and backup board 170, after the preliminary pin cutting operation is completed on both ends.

The pin insert 100 has an adjustment capability. The pin insert guide 110 may be moved forward to make the pin wider or moved rearward to make the pin smaller. The pin insert ball 105 is manipulated causing the pin insert guide vertical apex 117 to move forward or rearward as desired. The adjustment would have to take place before the making of the pin boards using scrap material.

Figure 36:
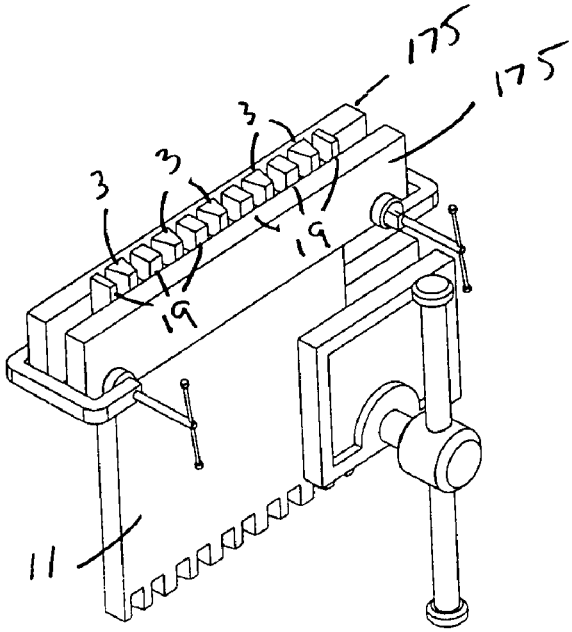
FIG. 36 is a perspective view of a pin workpiece sandwiched between two rectangular boards.
Figure 37A:
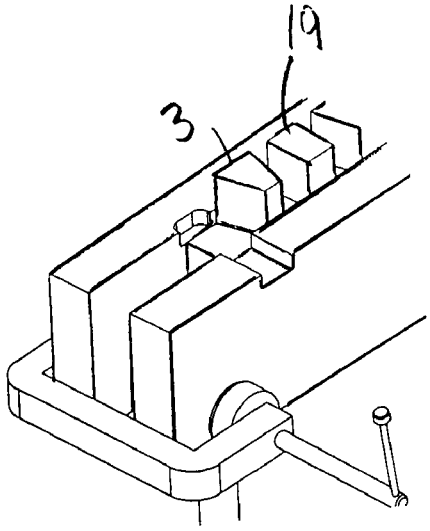
FIGS. 37A and 37B are perspective views of a pin workpiece after partial clearing operations.
Figure 37B:
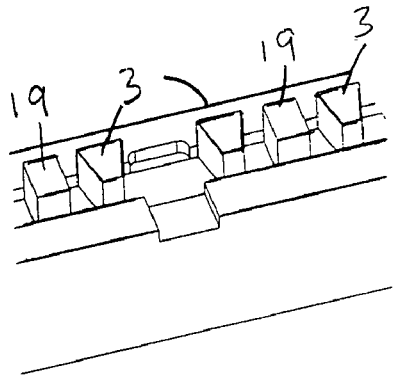
Figure 38:
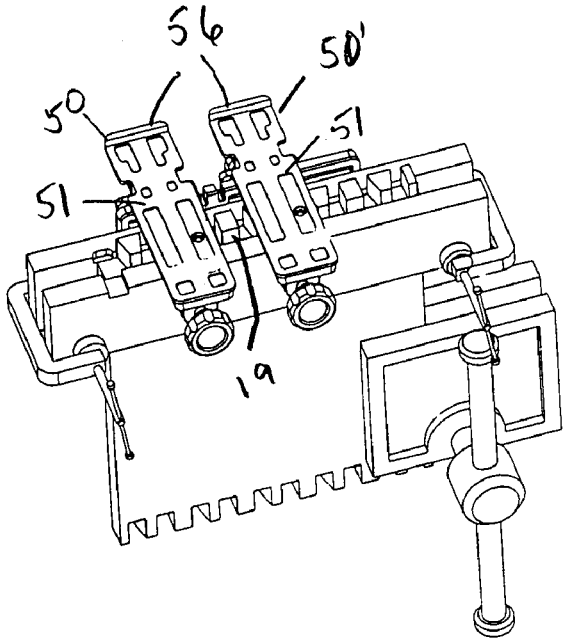
FIG. 38 is a perspective view of a jig mounted on a workpiece during clearing operations.
Figure 39:
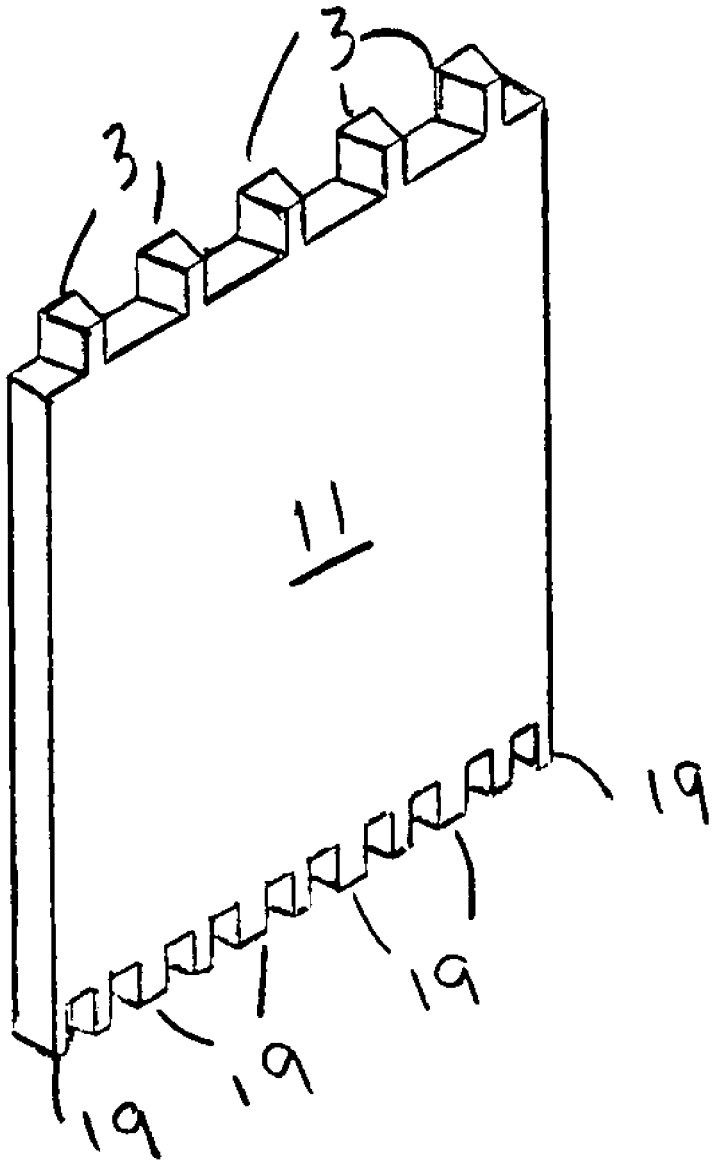
FIG. 39 is a perspective view of a pin board with unwanted material entirely removed.

The pin cutting operation has a final step and this involves removal of unwanted material 19 between pins 3. The pin insert 100 is removed from the jig 20. The pin workpiece is sandwiched between two rectangular boards 175 aligned along a line 18 at the junction of pin and board, i.e., base of the pins. See FIG. 36. The jig 20 is clamped over the workpiece top and the clamping bars positioned on each side of the material 19 to be removed. Specifically, the clamping bar interior edges are aligned to the corners of the pins on each side of the unwanted material. The left clamping bar 50 is set at the right edge of the pin adjacent the area to be cleared. The right clamping bar 50' is positioned at the left edge of the pin adjacent the area to be cleared. The separation between the clamping bar sides 55 facing each other defines the area to be cleared. The router 180 is then positioned on the clamping bar tops 51. The router is then turned on and manipulated between the clamping bars 50, 50' eliminating the unwanted material 19. See FIGS. 37A and 37B. The clamping bar top flanges 56 provide a router stop during the clearing operation. FIG. 39 illustrates a pin board with the unwanted material 19 between pins 3 entirely cleared from one end. This operation is repeated on the workpiece opposite end. See FIG. 38.

With the above operations completed, a dovetail joint 8 may be formed between one end of the pin board and one end of the tail board. The pins and tails should be perfectly aligned due to the use of the indexing boards when making the pins and tails.

It is understood that the above-described embodiment is merely illustrative of the application. Other embodiments may be readily devised by those skilled in the art which will embody the principles of the invention and fall within the spirit and scope thereof.

I claim:

1. A through dovetailing jig assembly, comprising:

a jig removably attached to a workpiece and adapted to guide a router cutter in forming through dovetail pins and tails;

a tail insert removably attached to said jig, said tail insert adapted to guide a router follower collar in cutting said tails in a workpiece;

a pin insert removably attached to said jig, said pin insert adapted to guide a router follower collar in cutting said pins in a workpiece;

a plurality of indexing boards for alignment of said pins and tails and attachable to said workpiece by said jig;

a plurality of front backup boards removably attached to said workpiece by said jig;

wherein said front backup boards are spaced from said indexing boards;

wherein said jig is comprised of:

a support base having a generally elongated, rectangular shape, with a top, a bottom, a left end, a right end, a front surface and a rear surface, said support base left and right ends defining a jig support base longitudinal axis, said jig support base front and rear surfaces lying in parallel vertical planes, said jig support base top and bottom lying in parallel horizontal planes, said support base top having an open rectangular notch formed therein extending from the jig support base front surface to the rear surface, said jig support base having a first aperture formed therein and extending from the jig support base front surface through to the jig support base rear surface, said jig support base having a second aperture with a horizontally elongated shape and extending from the jig support base front surface through to the jig support base rear surface, said second aperture being positioned between said first aperture and the support base right side; and two clamping bars removably attached to said support base, each clamping bar having a generally flat top, a bottom, a rear end, a front end, and two opposite, parallel, elongated sides, said jig clamping bar rear end and front end define a jig clamping bar longitudinal axis, said jig clamping bar longitudinal axis being transverse to the jig support base longitudinal axis, said jig clamping bar top having a horizontal plane perpendicular to a jig support base front surface vertical plane, said jig clamping bar top terminating in an upwardly extending flange at the clamping bar rear end, each clamping bar having a downwardly extending, bracing element protruding downwardly from the clamping bar bottom and positioned toward the clamping bar rear end, each clamping bar having a downwardly extending, holding element protruding downwardly from the clamping bar bottom and positioned toward the clamping bar front end;

wherein, each clamping bar is positioned with a portion of the clamping bar bottom on the jig support base top, each clamping bar positioned with the clamping bar bracing element adjacent the jig support base rear surface and the clamping brace holding element rear surface in front of the jig support base front surface;

wherein a left clamping bar is attached to said support base by means of fastening through the left clamping bar bracing element and through said support base first aperture;

wherein a right clamping bar is attached to said support base by means of fastening through the right clamping bar bracing element and through said support base second aperture.

2. A through dovetailing jig assembly as recited in claim 1, wherein:

the clamping bar sides each have a parallel, generally rectangular notch formed therein and extending from the clamping bar top to the clamping bar bottom, said rectangular notch having a forward and a rear vertical edge, said clamping bar notches positioned toward the clamping bar rear end, said clamping bar top extending laterally outwardly past and over each clamping bar side forming a top lip over each clamping bar side, said clamping bar top lip lying in the said jig clamping bar top horizontal plane, said clamping bar top lip also extending over the forward and rear vertical edges of each clamping bar side notch.

3. A through dovetailing jig assembly as recited in claim 2, wherein:

the tail insert has a front, a rear, two opposite sides, a flat top, and a bottom, said tail insert front and rear defining a tail insert longitudinal axis, said tail insert front having a rounded vertical channel formed therein and extending from the tail insert bottom to the tail insert top, said tail insert bottom having an elongated, indexing tab protruding centrally downward from the tail insert bottom extending from a point rearward of the front channel a desired distance toward the tail insert rear, said tail insert indexing tab having a longitudinal axis parallel to the tail insert longitudinal axis.

4. A through dovetailing jig assembly as recited in claim 3, wherein:

each tail insert opposite side terminates in a rectangular block formed laterally on each tail insert side, each said lateral block having a front, a rear, a top, a bottom, and a free side, said lateral block front and rear defining a lateral block longitudinal axis which is parallel to the longitudinal axis of the tail insert, each lateral block front being offset rearwardly from the tail insert front, each lateral block top being offset downwardly from the tail insert top, each tail insert lateral block adapted to fit into a clamping bar side notch beneath the clamping bar too lip wherein a clamping bar top lip engages a lateral block top, said tail insert indexing tab fitting into the jig support base top notch.

5. A through dovetailing jig assembly as recited in claim 4, wherein the pin insert is comprised of:

a pin insert adjustment base having a front, a rear, two opposite, parallel sides, a top and a bottom, said front and rear defining a pin insert adjustable base longitudinal axis, a generally rectangular opening formed centrally in the pin insert adjustable base extending from the pin insert adjustable base top through the base bottom, said central opening adapted to receive a pin insert guide adjustment chamber, said pin insert adjustment rear having a horizontal aperture formed along an adjustment base central, longitudinal axis opening into said pin insert adjustment base central opening, said adjustment base top being forwardly stepped downward to two flat platforms on each side of the central opening, each said platform having a circular aperture extending through to the pin insert adjustable base bottom, said pin insert adjustment base circular apertures being positioned proximate the pin insert adjustable base sides, said adjustment base top having a semi-circular channel formed between the platforms and between the central opening and adjustment base front, said semi-circular channel having a longitudinal axis coincident with an adjustment base central longitudinal axis, said pin insert adjustment base bottom having an elongated, indexing tab protruding centrally downward and extending from the pin adjustment base front to the pin adjustment base central opening, said pin insert adjustment base indexing tab having a longitudinal axis parallel to the pin insert adjustment base central longitudinal axis; and a pin insert guide adjustably connected to said pin insert adjustment base, said pin insert guide having a flat, rectangular top, a bottom, a front, a rear, and two parallel, opposite sides, said pin insert guide front protruding downwardly past the pin insert guide bottom, said pin insert guide front having a horizontal, V-shaped element protruding forwardly and terminating in a forward, vertical apex, said V-shaped element vertical apex and pin insert rear defining a pin insert guide longitudinal axis, said pin insert guide bottom having a generally rectangular adjustment chamber extending downwardly from a pin insert guide central, longitudinal axis.

6. A through dovetailing jig assembly as recited in claim 5, wherein:

each pin insert adjustment base side terminates in a rectangular block formed laterally on each pin insert adjustment base side, each said lateral block having a front, a rear, a top, a bottom, and a free side, said lateral block front and rear defining a lateral block longitudinal axis which is parallel to the longitudinal axis of the pin insert adjustment base, each lateral block front being offset rearwardly from the pin insert adjustment base front, each lateral block top being offset downwardly from the pin insert adjustment base top but above the platforms, the lateral block side opposite the free side having a portion which is exposed above the platform, each pin insert adjustment base lateral block adapted to fit into a clamping bar side notch beneath the clamping bar top lip wherein a clamping bar top lip engages a lateral block top, said pin insert adjustment base indexing tab fitting into the jig support base top notch.

7. A through dovetailing jig assembly as recited in claim 6, wherein:

each indexing board is comprised of a rectangular board having a plurality of parallel grooves formed along one surface, each said groove representing the desired position of a pin and a tail in a desired dovetail arrangement.

8. A through dovetailing jig assembly as recited in claim 7, wherein:

each front backup board is a comprised of a generally rectangular piece positioned in front of the work piece, said front backup board having a having a long side adjacent to a work piece top.

9. A through dovetailing jig assembly as recited in claim 8, wherein:

the jig support base top notch is positioned to the left of a jig support base longitudinal axis midpoint.

10. A through dovetailing jig assembly as recited in claim 9, wherein:

the jig support base rear surface has an elongated rear channel centrally formed therein, said rear channel extending nearly to the jig support base left end and right end, said jig support base rear channel having a longitudinal axis coincident with the fig support base longitudinal axis.

11. A through dovetailing jig assembly as recited in claim 10, wherein:

the clamping bar bracing element has a flat front wall facing toward the clamping bar front end and having a vertical plane perpendicular to the clamping bar top horizontal plane, said clamping bar bracing element front wall having two generally rectangular bracing protrusions formed therein, each bracing protrusion being positioned approximately centrally adjacent a clamping bar bracing element side, said clamping bar bracing element protrusions adapted to engage the jig support base rear surface rear channel;

the clamping bar bracing element has a rear surface and two opposite sides;

the clamping element bracing element has a cylindrical aperture formed therein, extending from the clamping element front wall to and through the clamping bar bracing element rear surface, said aperture being positioned centrally between said bracing protrusions, said clamping bar bracing element cylindrical aperture having a central axis parallel to the clamping bar longitudinal axis.

12. A through dovetailing jig assembly as recited in claim 11, wherein:

the clamping bar holding element has a flat front surface facing toward the clamping bar front end and having a vertical plane perpendicular to the clamping bar top horizontal plane, an opposite rear surface and two opposite sides;

the clamping element holding element has a cylindrical, threaded aperture formed therein, extending from the clamping element front surface to and through the clamping bar holding element rear surface, said threaded aperture being positioned centrally in said clamping bar holding element, said clamping bar holding element cylindrical, threaded aperture has a central axis parallel to the clamping bar longitudinal axis.

13. A through dovetailing jig assembly as recited in claim 12, wherein:

one clamping bar is designated the left clamping bar and is positioned between the jig support base left end and adjacent the jig support base top notch, and the other clamping bar is designated the right clamping bar between the jig support base top notch and jig support base right end.

14. A through dovetailing jig assembly as recited in claim 13, wherein:

the clamping bars are aligned so that the clamping bar side notches are positioned directly over the jig support base top.

15. A through dovetailing jig assembly as recited in claim 14, further comprising:

a threaded bolt inserted through the left clamping bar bracing element aperture into the jig support base cylindrical aperture from the jig support front surface, wherein a portion of the threaded bolt protrudes through and past the jig support rear surface;

a nut threadingly engaging the threaded bolt protruding portion thereby bracing the clamping bar to the jig support base;

a second threaded bolt inserted into the jig support base elongated aperture from the jig support front surface through the clamping bar bracing element aperture, wherein a portion of the second threaded bolt protrudes through and past the jig support rear surface;

a wing nut threadingly engaging the threaded bolt protruding portion thereby adjustably bracing the right clamping bar to the jig support base;

wherein the left clamping bar is in a fixed position within the jig and the right clamping bar is laterally adjustable.

16. A through dovetailing jig assembly as recited in claim 15, wherein:

each clamping bar has a holding element inserted through the clamping bar holding element threaded aperture, each holding element comprised of a threaded rod adapted to engage the threaded aperture of the clamping bar holding element, a holding element proximal end terminating in a knob adapted to manually manipulate the threaded rod, a holding element distal end terminating in a clamping foot.

17. A through dovetailing jig assembly as recited in claim 16, wherein:

the work piece is sandwiched between the front backup board and an indexing board, said indexing board having the grooves vertically aligned and facing away from the work piece;

the jig is positioned over the work piece top with the jig support base front surface adjacent the grooved surface of the index board;

wherein the holding element is positioned against the front backup board so that the holding element clamping foot directly engages the front backup board;

wherein the tail insert indexing tab and pin insert adjustment base indexing tabs engage one of the indexing board grooves.

18. A through dovetailing jig assembly as recited in claim 17, wherein:

the pin insert bottom adjustment chamber has a forward wall, a rearward wall, two opposite sides and an open bottom, said pin insert guide bottom forming an adjustment chamber top, said adjustment chamber rearward wall having a vertical aperture formed centrally therein.

19. A through dovetailing jig assembly as recited in claim 18, wherein:

two countersunk, elongated apertures are formed in the pin insert guide top, extending through to the pin insert bottom, said top elongated apertures being positioned proximate the pin insert guide sides.

20. A through dovetailing jig assembly as recited in claim 19, further comprising:

an adjustment bolt inserted into the pin insert adjustment base rear horizontal aperture wherein the adjustment bolt has a head positioned over the adjustment base opening, said adjustment bolt having a threaded shaft threadingly engaging a nut held in a holding chamber formed in the adjustment base top through to the adjustment base bottom, said adjustment bolt threaded shaft extending rearward past the adjustment base rear and terminating in a knob.

21. A through dovetailing jig assembly as recited in claim 20, wherein:

the adjustment base circular apertures open onto two nut holes in the adjustment base bottom, said nut holes shaped to hold a nut circumferentially in place.

22. A through dovetailing jig assembly as recited in claim 21, wherein:

the pin insert guide is joined to the pin insert adjustment base by placing the pin insert guide, bottom first, onto the adjustment base platforms;

wherein the pin insert guide front overlaps the adjustment base front;

wherein the pin insert guide sides abut the pin insert adjustable base rectangular block exposed side portions;

wherein the pin insert guide adjustment chamber fits over the pin insert adjustable base threaded adjustment bolt head wherein the bolt shaft protrudes through the adjustment chamber rearward wall vertical aperture;

wherein the pin insert guide is held to the pin insert adjustable base by means of two threaded fasteners inserted through the pin insert guide top apertures and through the pin insert adjustable base platform apertures;

wherein a threaded nut engages the threaded fastener in each of the nut holes in the pin insert adjustable base bottom.

* * * * *